US012582273B2

(12) United States Patent
Chicca et al.

(10) Patent No.: US 12,582,273 B2
(45) Date of Patent: Mar. 24, 2026

(54) FLIP-UP POTTY SEAT

(71) Applicant: KIDS2, LLC, Atlanta, GA (US)

(72) Inventors: Dana Chicca, Somerset, MA (US); Robert Blackadar, Worcester, MA (US)

(73) Assignee: KIDS2, LLC, Atlanta, GA (US)

( * ) Notice: Subject to any disclaimer, the term of this patent is extended or adjusted under 35 U.S.C. 154(b) by 87 days.

(21) Appl. No.: 18/526,984

(22) Filed: Dec. 1, 2023

(65) Prior Publication Data

US 2024/0180371 A1 Jun. 6, 2024

Related U.S. Application Data

(60) Provisional application No. 63/386,290, filed on Dec. 6, 2022.

(51) Int. Cl.

| | |
|---|---|
| ***A47K 13/06*** | (2006.01) |
| ***A47K 13/12*** | (2006.01) |
| ***A47K 13/26*** | (2006.01) |

(52) U.S. Cl.

CPC ..... *A47K 13/06* (2013.01); *A47K 13/12* (2013.01); *A47K 13/26* (2013.01)

(58) Field of Classification Search

CPC ..... A47K 13/06; A47K 13/12; A47K 13/26; A47K 13/005; A47K 13/02

(Continued)

(56) References Cited

U.S. PATENT DOCUMENTS 1,334,137 A * 3/1920 Delany ..... A47K 13/06 4/239
1,733,080 A * 10/1929 Hamilton ..... H04Q 3/00 4/245.3

(Continued)

FOREIGN PATENT DOCUMENTS

CN 204105866 1/2015
CN 104840142 6/2018

(Continued)

OTHER PUBLICATIONS

"International Search Report and Written Opinion received for PCT Patent Application No. PCT/US2023/082146, mailed on Feb. 14, 2024", 10 pages.

(Continued)

*Primary Examiner* — David J Walczak
(74) *Attorney, Agent, or Firm* — Adler Pollock & Sheehan P.C.

(57) ABSTRACT

A flip-up potty seat for a standard toilet includes a mount secured to the underside of the toilet lid by a removable attachment such as an adhesive pad, hook-and-loop fastener with adhesive, one or more suction cups, a magnet with adhesive, a fastener, or a clamp. A toilet-seat ring is joined to the mount by a living hinge and is positionable on the adult seat for potty-training use. Two stabilizer tabs on the ring engage the adult seat's inner opening to resist lateral movement. One or more hinged tabs on the mount are movable from flush to about-perpendicular and frictionally engage complementary recesses on the ring to retain the ring when flipped up. The assembly is thin enough to store between the lid and the seat with the lid closed, enabling rapid conversion between potty-training and adult use.

15 Claims, 19 Drawing Sheets

(58) Field of Classification Search
USPC ..... 4/235, 239
See application file for complete search history.

(56) References Cited

U.S. PATENT DOCUMENTS

| | | | | |
|---|---|---|---|---|
| 2,111,044 | A | 3/1938 | Crosby | |
| 4,516,279 | A | 5/1985 | Block | |
| 4,893,360 | A | 1/1990 | Wofford | |
| 5,685,023 | A | 11/1997 | Alston | |
| 5,749,104 | A | 5/1998 | Evans | |
| 6,449,780 | B1 | 9/2002 | Merry | |
| 6,564,396 | B1 | 5/2003 | Pitts | |
| 9,848,744 | B1 | 12/2017 | Hobbs | |
| 10,646,080 | B2 | 5/2020 | Regan | |
| 10,722,084 | B2 * | 7/2020 | Evans | A47K 13/14 |
| 11,026,547 | B2 | 6/2021 | Arndt | |
| 11,241,126 | B2 | 2/2022 | Mcconnell | |
| 2003/0097708 | A1 | 5/2003 | Zhang | |
| 2009/0044323 | A1 | 2/2009 | Feemster | |
| 2009/0070921 | A1 | 3/2009 | Young | |
| 2012/0042443 | A1 * | 2/2012 | Aguila | A47K 13/06 4/245.6 |
| 2013/0212793 | A1 | 8/2013 | Hand | |
| 2015/0327737 | A1 | 11/2015 | Fitch et al. | |

FOREIGN PATENT DOCUMENTS

| | | | |
|---|---|---|---|
| CN | 207768282 | | 8/2018 |
| CN | 211658040 | | 10/2020 |
| CN | 114680702 | | 7/2022 |
| DE | 20215922 | U1 | 4/2003 |
| GB | 375167 | A | 6/1932 |
| GB | 573004 | A | 11/1945 |
| JP | 4285637 | B2 | 4/2009 |
| KR | 20080011460 | A | 2/2008 |
| KR | 20160076752 | | 7/2016 |
| KR | 200487545 | | 11/2018 |

OTHER PUBLICATIONS

"Mayfair 83EC 000 NextStep Child/Adult Builtin Potty Seat with Lift-Off Hinges, Round, White", Retrieved Online via <https://www.amazon.in/Mayfair-83EC-000-NextStep-Lift-Off/dp/B00596IFBG> on Dec. 1, 2023, 6 pages.

"Topseat TinyHiney Round Potty Seat With Hinges", Retrieved Online via <https://www.target.com/p/topseat-tinyhiney-round-potty-seat-with-hinges/-/A-75668197> on Dec. 1, 2023, 12 pages.

Equiparts , "Toilet Seat—Nextstep® Built-In Pottyseat™ (White Elongated)", Retrieved Online via <https://store.equiparts.net/83258-toilet-seat-nextstep-built-in-potty-seat-white-elongated.html> on Dec. 1, 2023, 2 pages.

Royal Crown, "Royal Crown RCTS101 Family Toilet Seat, New Elongated/Round Thin Design, Adult/Child with Silent Close and Quick Release Button, Built in Child Potty Training Seat/Cover, Integrated" Retrieved Online via <https://www.amazon.in/Royal-Crown-RCTS101-Elongated-Integrated/dp/B01JP1YGAO> on Dec. 1, 2023, 2 pages.

* cited by examiner

FLIP-UP POTTY SEAT

CROSS-REFERENCE TO RELATED APPLICATIONS

This application claims benefit and priority from U.S. Provisional Patent Application No. 63/386,290, filed on Dec. 6, 2022, which is incorporated by reference herein in its entirety.

FIELD OF THE INVENTION

The present invention generally relates to child potty training seats, and in particular, to a flip-up potty seat for use with regular (e.g., adult sized) toilets and toilet seats.

BACKGROUND OF THE INVENTION

Training young children or toddlers to use an adult-sized toilet (i.e., "potty training") is known as a required task of child rearing that can eventually bring much needed relief from the diaper changing. Unfortunately, potty training is an activity that is, to this day, still unpredictable, imprecise, and prone to fear, apprehension, and error. During potty training, kids are often apprehensive and unaware of the physical cues that indicate the bowel or bladder needs to be evacuated. Furthermore, upon taking the child to a regular (adult-sized) toilet seat, the task may nevertheless be time consuming, unpredictable or nerve racking. With technological advances, smart phones and the increasingly faster pace of modern life, the time and stress required for potty training has only increased. As such, there is an urgent need for a better way of potty-training young children or toddlers.

BRIEF SUMMARY OF THE INVENTION

The following presents a brief summary of the innovation in order to provide a basic understanding of some aspects of the invention. This summary is not an extensive description of every feature of the invention. It is intended to neither identify all the key or critical elements of the invention nor delineate the entire scope of the invention. Its purpose is to present some concepts of the invention in a shorter reading form as an overall introduction to the more detailed description that is presented later.

Disclosed is a flip-up potty seat for use with regular (e.g., adult) toilets, toilet lids, and toilet seats. In one embodiment, the flip-up potty seat can be thin enough so as to fit into the space between the toilet seat and the lid of a regular, adult toilet seat so that the flip-up potty seat can be safely stored therein when the lid is closed. In another embodiment, the flip-up potty seat can be integrally molded as a single piece using materials such as plastic or other suitable flexible materials. In such a process of making the flip-up potty seat it can be described as consisting essentially of a single flexible material, such as a polymer or thermoelastic polymer/plastic.

In one embodiment, the flip-up potty seat includes a mount that can attach to an underside of the (adult size) toilet lid with adhesive strips, suction cups, or other suitable fasteners. The flip-up potty seat can include a living hinge that is integrally molded into the seat and allows a ring of the flip-up potty seat to be flipped up and out of the way so as to enable an adult regular use of the toilet seat.

In another embodiment, the flip-up potty seat can be easily installed on the regular adult toilet without the use of any mechanical fasteners or tools or both.

In some embodiments, a flip-up potty seat operative for potty training of toddlers on a regular, adult-sized toilet seat is disclosed herein, the flip-up potty seat comprising: a mount operative to be attached to a toilet lid of a regular, adult-sized toilet seat's lid; a flip-up toilet seat ring connected to the mount via a hinge, wherein the ring can be positioned down on the toilet seat of the regular, adult-sized toilet seat; wherein the ring is thereby in a potty-training use position; and wherein the ring can be flipped up from the toilet seat to contact the mount and to stay in contact with the mount; wherein the ring is thereby in a regular, adult use position or a stowed position.

In some embodiments, the flip-up potty seat can be further comprising one or more tabs on the mount capable of engaging with a portion of the ring when the ring is flipped up to contact the one or more tabs on the mount; wherein the one or more tabs are operative to hold the ring in the flipped-up position until the ring is pulled down to the potty-training use position. The one or more tabs can be configured as magnets, hook-and-loop fasteners, suction (cups), or any other suitable fastener known in the art.

In some embodiments, the flip-up potty seat can be further comprising one or more complementary recesses on the ring, oppositely disposed to the one or more tabs; wherein the one or more complementary recesses can frictionally engage with the one or more tabs on the mount. The one or more complementary recesses can be, in some embodiments, configured as metal or magnets or complimentary hook-and-loop material if, as discussed above, the one or more tabs are configured with a different fastener known in the art.

In some embodiments, the flip-up potty seat can be configured wherein the one or more tabs each include a hinge operative to dispose each tab in a flush position with the mount and to dispose each tab in an engagement position about perpendicular from the mount.

In some embodiments, the flip-up potty seat is configured wherein the hinge is a living hinge. It is contemplated that any hinge or material suitable to provide the concepts disclosed herein can be utilized and the manufacturing (method of making) can be determinative.

In some embodiments, the flip-up potty seat is configured wherein the mount can be attached to the underside of the toilet lid of the regular, adult-sized toilet lid by any means known in the art. For example, wherein the mount is attached with an adhesive pad, a hook-and-loop fastener (e.g., Velcro®) with adhesive, one or more suction cups, a magnet with adhesive, a fastener or a clamp.

In some embodiments, the flip-up potty seat is configured further comprising two stabilizer tabs projecting downwards from the ring; wherein the two stabilizer tabs are operative to engage with the toilet seat's inner hole of the regular, adult-sized toilet seat and stabilize the ring in the potty-training use position.

In some embodiments, the flip-up potty seat is such that the two stabilizer pads are hinged and operative to be moved flush with the ring when the ring is flipped-up to the adult-use position or storage position.

In some embodiments, the flip-up potty seat, which is further comprising the two stabilizer tabs, is configured such that the tabs are elongated to form a stabilizing ring or at least a portion of a stabilizing ring that is operative to engage with the adult toilet seat's inner hole of the regular, adult-sized toilet seat and stabilize the ring in the potty-training use position.

In a general description of the embodiments, the flip-up potty seat is wherein the ring of the flip-up potty seat reduces the dimension of the toilet seat's inner hole of the regular, adult-sized toilet seat (such that a toddler or smaller child will not fall through the hole). As can be envisioned, the flip-up potty seat is configured wherein the reduced dimension of the inner hole is operative to provide comfort while preventing a toddler or child from falling through the inner hole of the regular, adult-sized toilet seat.

In some embodiments, the flip-up potty seat is wherein the flip-up toilet seat ring can be positioned down on the toilet seat of the regular, adult-sized toilet seat, in the potty-training use position and then flipped-up to the adult use position or a stowed position in less than 5 seconds; and/or wherein the flip-up toilet seat ring can be flipped-down from the adult use position or stowed position into the potty-training use position in less than 5 seconds. In some embodiments, the flip-up toilet seat ring can be positioned down on the toilet seat of the regular, adult-sized toilet seat, in the potty-training use position and then flipped-up to the adult use position or a stowed position in less than 1 second; and/or wherein the flip-up toilet seat ring can be flipped-down from the adult use position or stowed position into the potty-training use position in less than 1 second.

In some embodiments, the flip-up potty seat is configured further comprising a molded bead extending down from an outer circumference of the underside of the flip-up toilet seat ring and operative to provide a grip on or around the outer circumference of the regular, adult-sized toilet seat. In some embodiments, the flip-up potty seat is configured, further comprising one or more underside non-slip ribs including a molded bead extending from the inner hole of the flip-up potty seat to the outer circumference of the flip-up potty seat or along a span of the underside of the flip-up potty seat and each rib operative to provide rigidity and/or strength to the flip-up potty seat.

In some embodiments, the flip-up potty seat disclosed herein enables a substantially instant or an almost instantaneous conversion of a regular, adult-sized toilet seat to a potty-training use position and vice versa. The flip-up potty seat disclosed herein can improve sanitation compared to a potty chair.

In some embodiments, the flip-up potty seat consists of the mount, the flip-up ring and the hinge. In some embodiments, the flip-up potty seat consists essentially of a single material meaning as such that the entire flip-up potty seat, living hinge and mount is made by being injection-molded from a single material. In various examples, the flip-up potty seat is formed from a recyclable material (e.g., an injection-molded plastic or polymer).

In some embodiments, a method of potty training a toddler is disclosed herein, the method including the steps of: (1) obtaining a flip-up potty seat of any preceding description with mount engaged with the lid and the ring positioned down on the toilet seat of the regular, adult-sized toilet seat in the potty-training use position; (2) positioning a toddler over the ring in a potty seated position on the ring; and (3) encouraging the toddler; whereby the toddler remains seated for a sufficient period of time. Over time, the toddler becomes potty trained.

In some embodiments, a method of converting a regular, adult sized toilet seat to a potty-training toilet seat (and/or vice versa) is disclosed herein, the method comprising the steps of: (1) obtaining a flip-up potty seat of any of the embodiments herein with mount engaged with the lid and the ring positioned up from the toilet seat to contact the mount and to stay in contact with the mount; wherein the ring is thereby in a regular, adult use position or a stowed position; and (2) flipping the ring down from contact with the mount to contact the regular, adult sized toilet seat and to be in the potty-training use position; wherein an execution of step (1) and/or step (2) is utilized as needed to interconvert from the potty-training use position to (or from) the regular, adult use position (or the stowed position). For example, in some embodiments, this method can be executed in less than about 5 seconds, in less than about 1 second, or about instantly.

In some embodiments, a method of converting a regular, adult-sized toilet to a potty-training or special use toilet or vice versa, the method comprising the steps of: (A) obtaining a flip-up potty seat of any one of the embodiments described herein and engaging the mount with the lid of an adult-sized toiled seat; (B) flipping the ring down onto a toilet seat of the regular, adult-sized toilet, whereby the ring transitions to the potty-training position; and (C) flipping the ring up to contact the mount and to stay in contact with the mount; wherein the ring transitions to the regular, adult use position or stowed position. For example, this method can, in some embodiments, enables an interconversion of the regular, adult-sized toilet in less than 5 seconds after the mount is attached to the lid.

It is contemplated that the flip-up potty seats and methods can be portable and carried to airports, restaurants or any restrooms as such. In some embodiments, the methods disclosed herein can be wherein the method is executed by a toddler and/or a child after the toddler and/or child is shown the method at least once.

The methods disclosed herein are more sanitary than a potty chair, which requires emptying of a receptacle. For example, any of the methods disclosed herein can further comprise flushing said toilet or encouraging a toddler or a child to flush said toilet.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

For the purpose of illustration, certain embodiments of the present invention are shown in the drawings, which are briefly described below. It should be understood, however, that the invention is not limited to the precise arrangements, data, dimensions, and illustrations shown. In the drawings:

To demonstrate various possible (but non-limiting) shapes, FIG. 14A shows an example of a D shape toilet seat. FIG. 14R shows an example of a Zagara (custom) toilet seat[2].

DETAILED DESCRIPTION OF THE INVENTION

Figure 1:
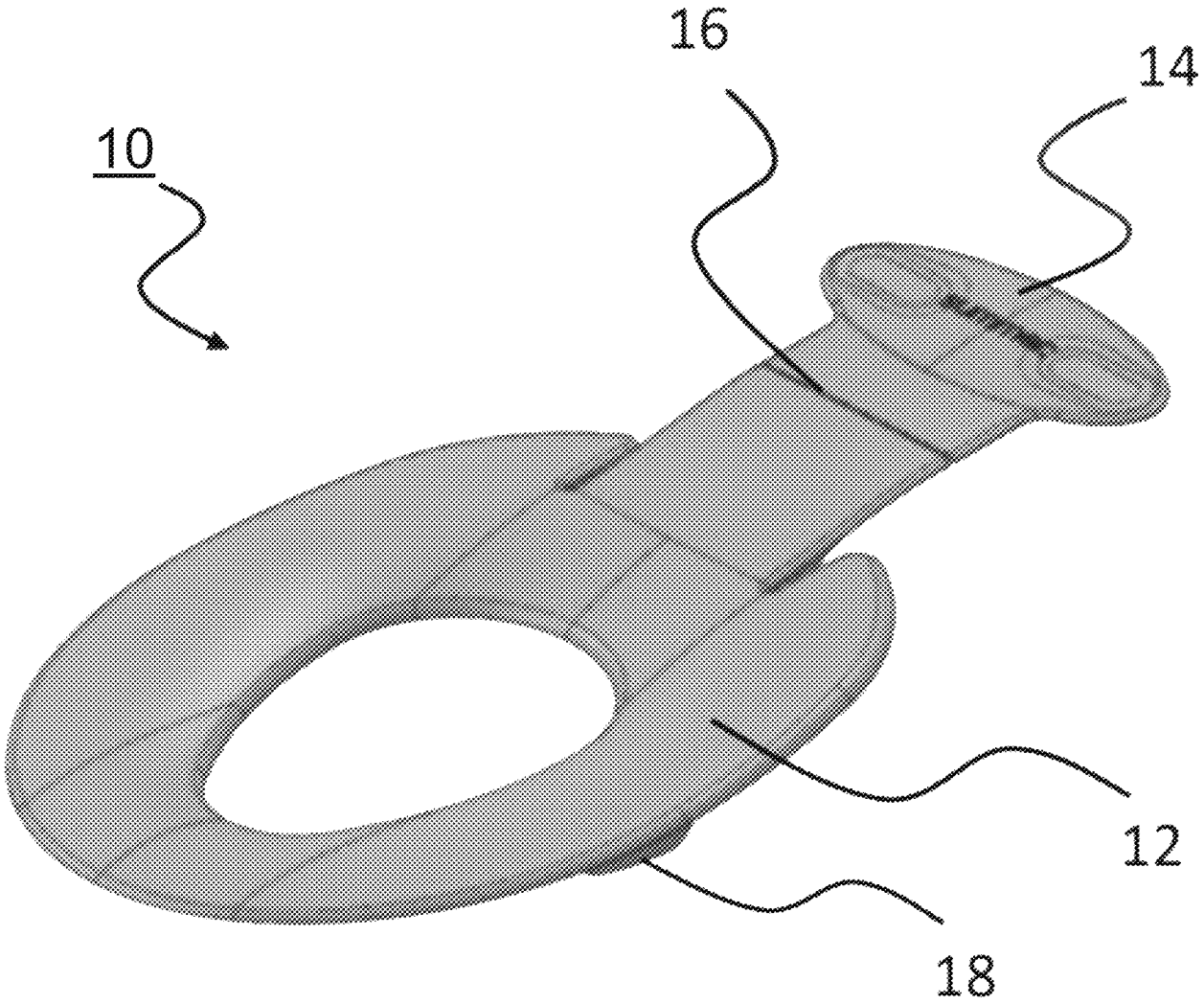
FIG. 1 is a perspective, top view of a flip-up potty seat according to an embodiment.

The presently disclosed innovation is now described in more detail with initial reference to the drawings, wherein like reference numerals are used, when practical, to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are illustrated in a block diagram form in order to facilitate describing the present invention. The full benefits provided by the technology can be discerned after envisioning the actual use during potty training, for example, the time, worry and mess saved by the technology herein.

As such, the following description of particular aspects is merely exemplary in nature and is in no way intended to limit the scope of the invention, its application, or uses, which may, of course, vary. The invention is described with relation to the non-limiting definitions and terminology included herein. These definitions and terminology are not designed to function as a limitation on the scope or practice of the invention but are presented for illustrative and descriptive purposes only. While the compositions or processes are described as using specific materials or an order of individual steps, it is appreciated that materials or steps may be interchangeable such that the description of the invention may include multiple parts or steps arranged in many ways as is readily appreciated by one of skill in the art.

Definitions

The definitions of certain terms as used in this specification and the appended claims are provided below. Unless defined otherwise, all technical and scientific terms used herein generally have the same meaning as commonly understood by one of ordinary skill in the art to which this invention belongs.

As used in this specification and the appended claims, the singular forms "a," "an" and "the" include plural referents unless the content clearly dictates otherwise. For example, reference to "a cell" includes a combination of two or more cells, and the like.

The term "approximately" or "about" in reference to a value or parameter are generally taken to include numbers that fall within a range of 5%, 10%, 15%, or 20% in either direction (greater than or less than) of the number unless otherwise stated or otherwise evident from the context (except where such number would be less than 0% or exceed 100% of a possible value). As used herein, reference to "approximately" or "about" a value or parameter includes (and describes) embodiments that are directed to that value or parameter. For example, description referring to "about X" includes description of "X".

As used herein, the term "or" means "and/or." The term "and/or" as used in a phrase such as "A and/or B" herein is intended to include both A and B; A or B; A (alone); and B (alone). Likewise, the term "and/or" as used in a phrase such as "A, B, and/or C" is intended to encompass each of the following embodiments: A, B, and C; A, B, or C; A or C; A or B; B or C; A and C; A and B; B and C; A (alone); B (alone); and C (alone).

It is understood that wherever embodiments are described herein with the language "comprising" otherwise analogous embodiments described in terms of "consisting of" and/or "consisting essentially of" are also provided. It is also understood that wherever embodiments are described herein with the language "consisting essentially of" otherwise analogous embodiments described in terms of "consisting of" are also provided.

It is to be appreciated that certain features of the invention which are, for clarity, described herein in the context of separate embodiments, may also be provided in combination in a single embodiment. Conversely, various features of the invention that are, for brevity, described in the context of a single embodiment, may also be provided separately or in any sub-combination. Further, reference to values stated in ranges include each and every value within that range. If a range is stated, all values within that range are subsumed as endpoints for new ranges to be cited as specific embodiments in the claims.

The term "toddler" is found in the Merriam-Webster English Dictionary (MW) as a young child usually between one and three years old. MW defines an "infant" as "a child in the first period of life". The term "child" is found in MW as "a young person especially between infancy and puberty". The term "disabled" is found in MW as "a: impaired or limited by a physical, mental, cognitive, or developmental condition" and "b: incapacitated by illness or injury". It should be understood that the technology disclosed herein can be utilized to improve the life of any mammal, human, child, infant, toddler, disabled or otherwise in need of a better flip-up potty seat. In some embodiments, the technology drastically improves the life of parents or caregivers who are trying to help another person on the potty. As such, while the technology might be described in the context of potty training, the technology can benefit the elderly, the disabled, the young, the normal middle-aged and any person in need of comfort on a toilet. Specifically, no matter how the technology is described it is not limited by the descriptions herein as it is contemplated that the technology provides sanitary alternatives in many situations.

Unless otherwise defined, all terms (including technical and scientific terms) used herein have the same meaning as commonly understood by one of ordinary skill in the art to which this disclosure belongs. It will be further understood that terms such as those defined in commonly used dictionaries, should be interpreted as having a meaning that is consistent with their meaning in the context of the relevant art and the present disclosure, and will not be interpreted in an idealized or overly formal sense unless expressly so defined herein.

The technology can be made of any material. Polymers, plastics and thermoplastics are envisioned, particularly recycled content. The present disclosure encompasses the preparation and use of solvates polymers for manufacturing the flip-up potty seats. Solvates typically do not significantly alter the properties or toxicity of the polymers, and as such may function as equivalents. The term "solvate" as used herein is a combination, physical association and/or solvation of a compound of the present disclosure with a solvent molecule such as, e.g., a disolvate, monosolvate or hemisolvate, where the ratio of solvent molecule to compound of the present disclosure is about 2:1, about 1:1 or about 1:2, respectively. This physical association involves varying degrees of ionic and covalent bonding, including hydrogen bonding. In certain instances, the solvate can be isolated, such as when one or more solvent molecules are incorporated into the crystal lattice of a crystalline solid. Thus, "solvate" encompasses both solution-phase and isolatable solvates. One type of solvate is a hydrate. A "hydrate" relates to a particular subgroup of solvates where the solvent molecule is water. Solvates typically can function as equivalents. Preparation of solvates is known in the art. For example, a polymer is dissolved in water and methanol (or other solvent), dried, and the resulting O—H stretch (from the formation of the solvate/hydrate) is confirmed by an ATR-IR measurement. The O—H stretch is not found in the non-solvate/hydrate form, quickly confirming the formation of the solvate/hydrate in the solid form by the ATR-IR measurement. A solvate can be used (e.g., in thermoplastic elastomers) to enhance the feel of a polymer.

In particular referral to the Definitions used herein, a "small molecule" refers to a chemical that has a molecular weight of 1000 or less in a free form (i.e., as measured in a non-salt form). A reference to a "large molecule" refers to a molecular weight of greater than 1000.

As used herein, a "living hinge" refers to a thin flexible hinge (or flexure bearing) made from the same material as the two rigid pieces it connects or made from a thin flexible material connecting two rigid pieces that it connects. It should be understood that a living hinge can be used at any hinge in this technology or a non-living hinge can be used, but the living hinges can provide, for example, greater ease of manufacturing.

Flip-Up Potty Seats and the Methods Enabled

Figure 16:
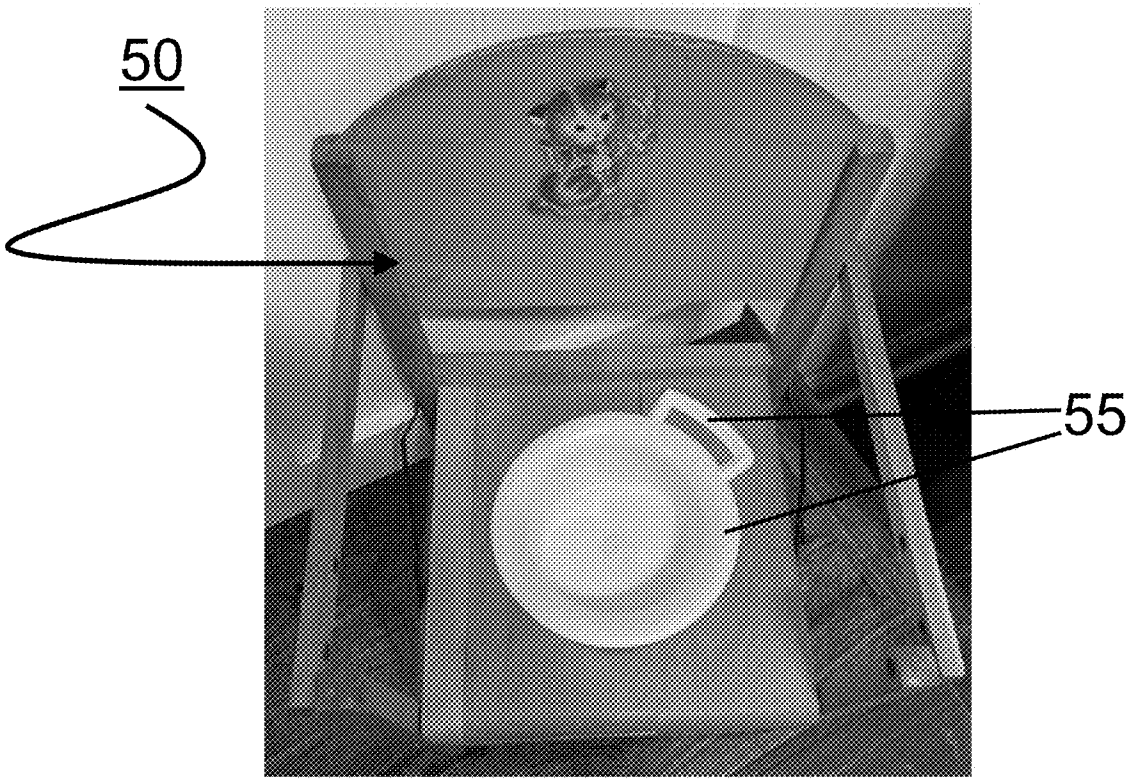
FIG. 16 (Prior Art)
FIG. 16 (Prior Art) shows an example of a potty chair 50 with a waste receptacle 55.

As discussed below, the technology disclosed herein can be applied globally to toilets of various shapes and sizes. The technology disclosed herein can eliminate the need for "potty-chairs". Potty-chairs are defined by Merriam-Webster's Dictionary as: "a child's chair having an open seat under which a receptacle is placed for toilet training"[3] A potty chair requires tedious monitoring, emptying and cleaning (e.g., FIG. 16). Now referring to FIG. 16, in general, a potty chair is a proportionately small chair containing a bucket or enclosure with an opening for seating very young children or toddlers to "go potty." In contrast, the presently disclosed technology is advanced and enables quick interconversion of an adult toilet to accommodate very young children (e.g., FIG. 3) or toddlers and then back to accommodate adults (e.g., FIG. 4).

Disclosed herein are various embodiments of the flip-up potty seats for use with regular (e.g., adult) toilets, toilet lids, and toilet seats. For example, at a home, the flip-up potty seats can be thin enough so as to fit into the space between the toilet seat and the lid of a regular, adult toilet seat so that the flip-up potty seat can be safely stored therein when the lid is closed. In another example, the ring of the flip-up potty seat is sufficiently thin so that when it is flipped-up to the adult-use position, the adult can comfortably position their back against the ring along with the backrest (lid) of the adult-size toilet lid.

In some embodiments, the flip-up potty seat can be integrally molded as a single piece using materials such as a plastic (or TPE) or other suitable flexible materials, making the method of manufacture convenient and optionally in a single injection step. It is to be understood that in such a process of making the flip-up potty seat it can be described as "consisting essentially of" a single flexible material, such as a polymer or thermoelastic polymer/plastic, and the method of making becomes significant, for example, for cost reasons, for recycling reasons (e.g., single material recycling), or for other reasons. In some embodiments, the technology can be manufactured in a single injection of a polymer into an injection mold.

Figure 3:
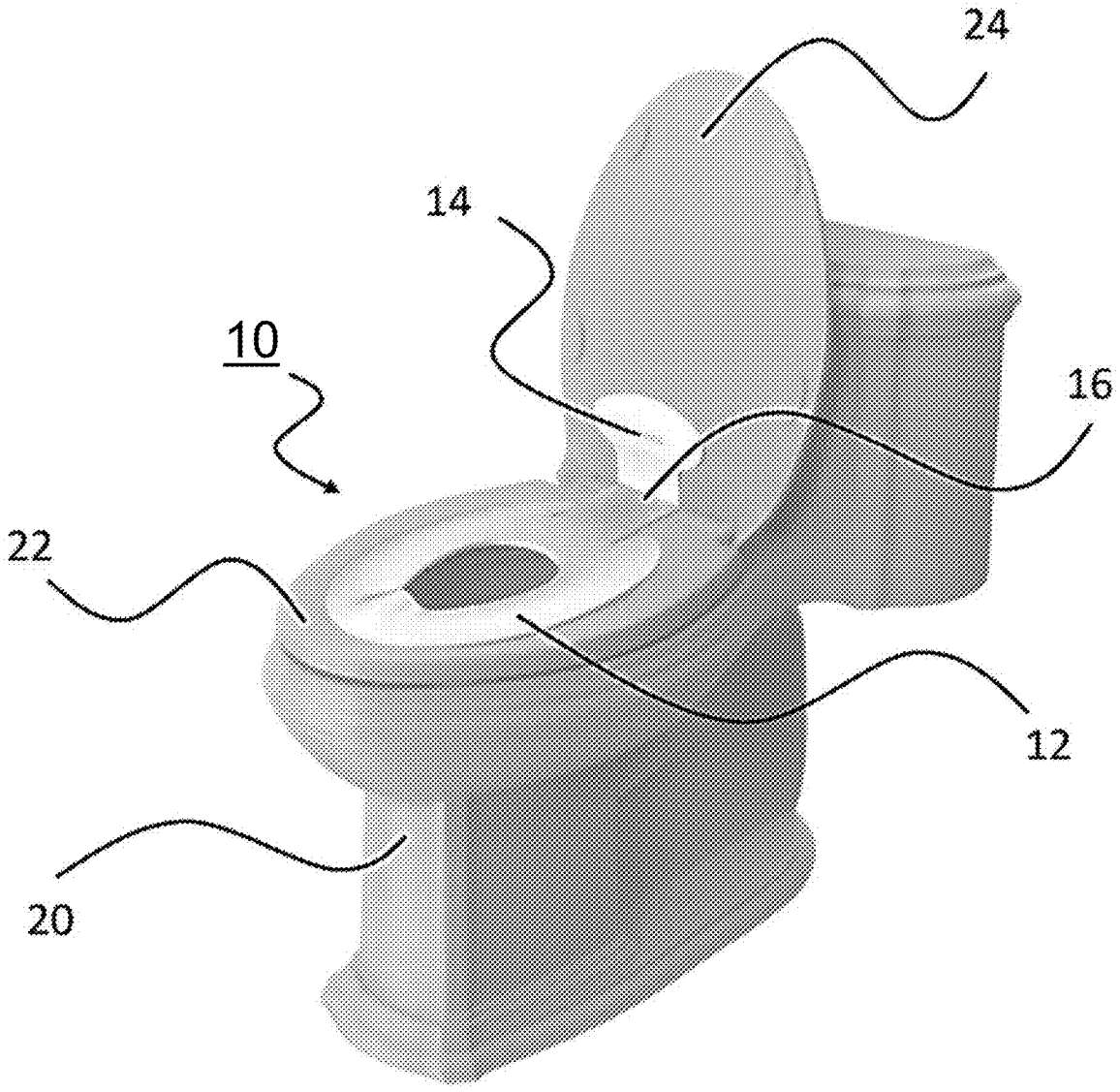
FIG. 3 is a perspective top view of the flip-up potty seat in a potty-training position (or toddler in-use configuration) on an adult sized toilet.

Reference is now made to FIG. 1 illustrating a perspective view of a flip-up potty seat 10 according to an embodiment of the present disclosure. As shown, the flip-up potty seat 10 includes a ring 12 that can be connected to a mount 14 via a living hinge 16. The ring 12 can be substantially oval in shape to coincide with the toilet seat of a regular, adult-sized toilet. It is contemplated that in alternative shapes, the ring 12 can accommodate (or fit) a variety of shapes illustrated in example shapes of FIGS. 14A-14R and the ring 12 can span or accommodate an open fronted shape illustrated in FIG. 15. This is best illustrated in FIG. 3, which shows the ring 12 being positioned on a toilet seat of a regular, adult-sized toilet.

Turning back now to FIG. 1, the mount 14, meanwhile, is also shown to be substantially oval in shape but can take on any shape or size. In operation, the mount 14 can be attached to the lid of a regular, adult toilet, also best illustrated in FIG. 3. It should be understood that the mount can be attached to the lid by any means known in the art.

In one embodiment, the flip-up potty seat including the mount can be wherein the mount can attach to an underside of the toilet lid with adhesive strips, suction cups, hook-and-loop fastener with adhesive, or other suitable fasteners. The flip-up potty seat can include a living hinge that is integrally molded into the seat and allows a ring of the flip-up potty seat to be flipped up and out of the way so as to enable an adult regular use of the toilet seat.

In one embodiment, the ring 12 as well as the mount 14 and the hinge 16 of the flip-up potty seat 10 can be integrally formed or molded as a single piece. In other words, the ring 12, the mount 14 and the hinge 16 can be produced as an integrated, single component from materials such as plastic or other suitable flexible materials. The process for forming the flip-up potty seat 10 as a single piece or as a single component can be carried out using known manufacturing processes (e.g., plastic injection molding).

In an example, the flip-up potty seat can be easily installed on the regular adult toilet without the use of any mechanical fasteners or tools or both.

Figure 2:
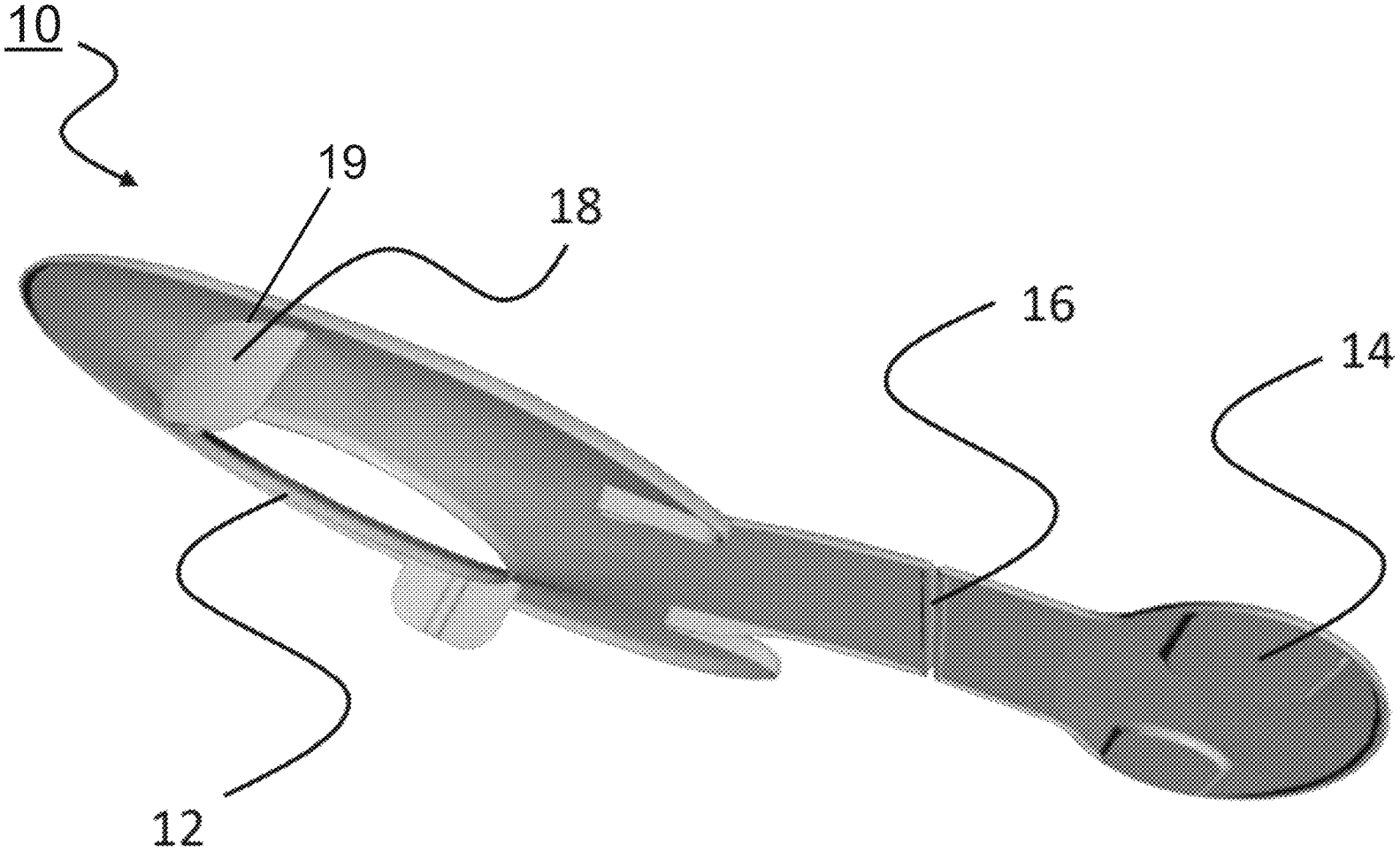
FIG. 2 is a perspective view of the flip-up potty seat of FIG. 1 as viewed from the bottom/side.

In one embodiment, the bottom of the ring 12 can include a pair of stabilizer tabs 18 as is illustrated in FIG. 2, which is a perspective view of the flip-up potty seat 10 from the bottom/side. As shown, the stabilizer tabs 18 can extend substantially downward from the ring 12 of the flip-up potty seat 10. In operation, the tabs 18 can help to stabilize the ring 12 as the flip-up potty seat 10 is positioned on the toilet seat of a regular, adult-sized toilet so as to prevent the ring 12 of the flip-up potty seat 10 from moving about when the young child or toddler is using the flip-up potty seat 10 (e.g., when the young child or toddler's rear end is seated on and makes physical contact with the ring 12). And like above, the tabs 18 can also be integrally formed with the other parts of the flip-up potty seat 10, especially the ring 12. In an alternative example, the tabs 18 can be detachably coupled to the ring 12 via suitable fasteners such as glue or adhesives and can be optionally installed by a user prior to installation of the flip-up potty seat 10 on the adult-sized toilet. As discussed further below, in some embodiments, the tabs 18 need not be necessary due to presence of other aspects and the flip-up potty seat 10 can be installed without them. In some embodiments, the tabs 18 can be attached by a flexible living hinge 19 that enables the tabs to be flexed out of the way when the seat is flipped-up into a regular, adult use position (e.g., with the adult's back in contact with the seat in a backrest, flipped-up or adult use position).

In the various embodiments, it can be envisioned that the flip-up potty seat 10 can be formed of a material that is thin enough so as to fit into the space between the toilet seat and the lid of the regular, adult toilet when the lid of the regular, adult toilet is closed.

Reference is now made to FIG. 3 illustrating a perspective view of the flip-up potty seat 10 in an in-use (potty-training use) configuration when installed on a regular, adult-sized toilet 20. As shown, the mount 14 of the flip-up potty seat 10 can be attached to an underside of the toilet lid 24 with adhesive strips, suction cups, any suitable means known, or suitable fasteners. Meanwhile, the ring 12 of the flip-up potty seat 10 can be positioned on the regular, adult-sized toilet seat 22 of the toilet 20 with the tabs 18 (optional). The ring 12 and the mount 14 remain connected via the living hinge 16, which has the flexibility in making this possible because it can be made during the same manufacturing process as the ring 12 and the mount 14. And because all three components 12, 14, 16 can be made from the same material, they can also be made with similar thicknesses so as to be thin enough to be stored on the toilet 20 when not in use. In this aspect, the method of making can be referred to as "consisting essentially" of and included in a claim of the flip-up potty seat to distinguish the cost-saving and effective feature of this method.

Once mounted, the ring 12 of the flip-up potty seat 10 reduces the dimension of a normal, adult-sized toilet seat 22 to something that a child can feel comfortable with. Additionally, because of the reduced dimension, a child will be able to use a regular, adult-sized toilet 20 without the discomfort or fear of falling through the toilet seat 22 and into the toilet bowl. Furthermore, because of the stabilizer tabs 18 (tabs are not shown in FIG. 3 but are shown in FIG. 4), the ring 12 will not move about as the child is using the flip-up potty seat 10 during potty training.

Figure 4:
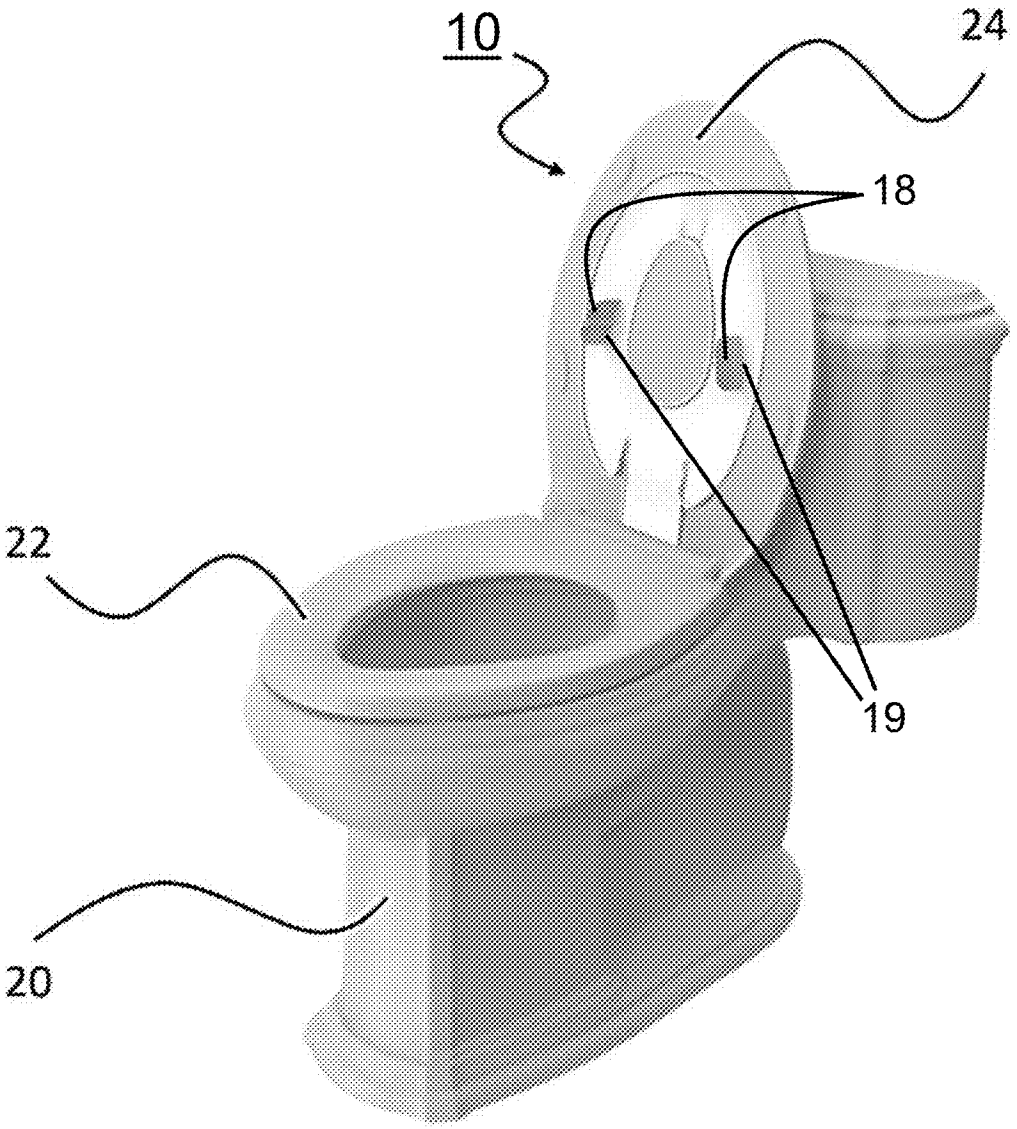
FIG. 4 is a perspective view of the flip-up potty seat in an adult-use, regular, or stowed away (or flipped-up) configuration on the adult sized toiled of FIG. 3.

Reference is now made to FIG. 4 illustrating a perspective view of the flip-up potty seat 10 in a stowed (or adult-use) configuration when installed on a regular, adult-sized toilet 20. While this is a stowed configuration, it is understood that this stowed configuration is not for that of a child or toddler. This stowed configuration allows the toilet 20 to be converted back to a regular, adult-sized toilet 20 for use by an adult or grown up, as the ring 12 is flipped up and out of the way. In some embodiments, it is contemplated that the stabilizer tabs 18 can optionally be flexed at a living hinge 19 in order for an adult to place their back against the ring (sitting). Importantly, the stowed (or adult-use) position allows the toilet to be used as normal. Interestingly, the toilet can be converted from adult-use to potty-training use very quickly in a conversion method (e.g., FIG. 11, Example 2).

In this stowed configuration, the ring 12 can be "flipped up" and out of the way. In this instance, the entirety of the flip-up potty seat 10 is secured about an underside of the toilet lid 24. This can be made possible once again because the living hinge 16 is integrally molded into the flip-up potty seat 10 connecting the ring 12 and the mount 14 thereby allowing the ring 12 to pivot or rotate upwardly and out of the way so as to enable an adult or a grown up the use of the regular toilet seat 22.

As such, in some embodiments, a flip-up potty seat operative for potty training of toddlers on a regular, adult-sized toilet seat is disclosed herein, the flip-up potty seat comprising: a mount operative to be attached to a toilet lid of a regular, adult-sized toilet seat's lid; a flip-up toilet seat ring connected to the mount via a hinge, wherein the ring can be positioned down on the toilet seat of the regular, adult-sized toilet seat; wherein the ring is thereby in a potty-training use position; and wherein the ring can be flipped up from the toilet seat to contact the mount and to stay in contact with the mount; wherein the ring is thereby in a regular, adult use position or a stowed position.

Figure 5:
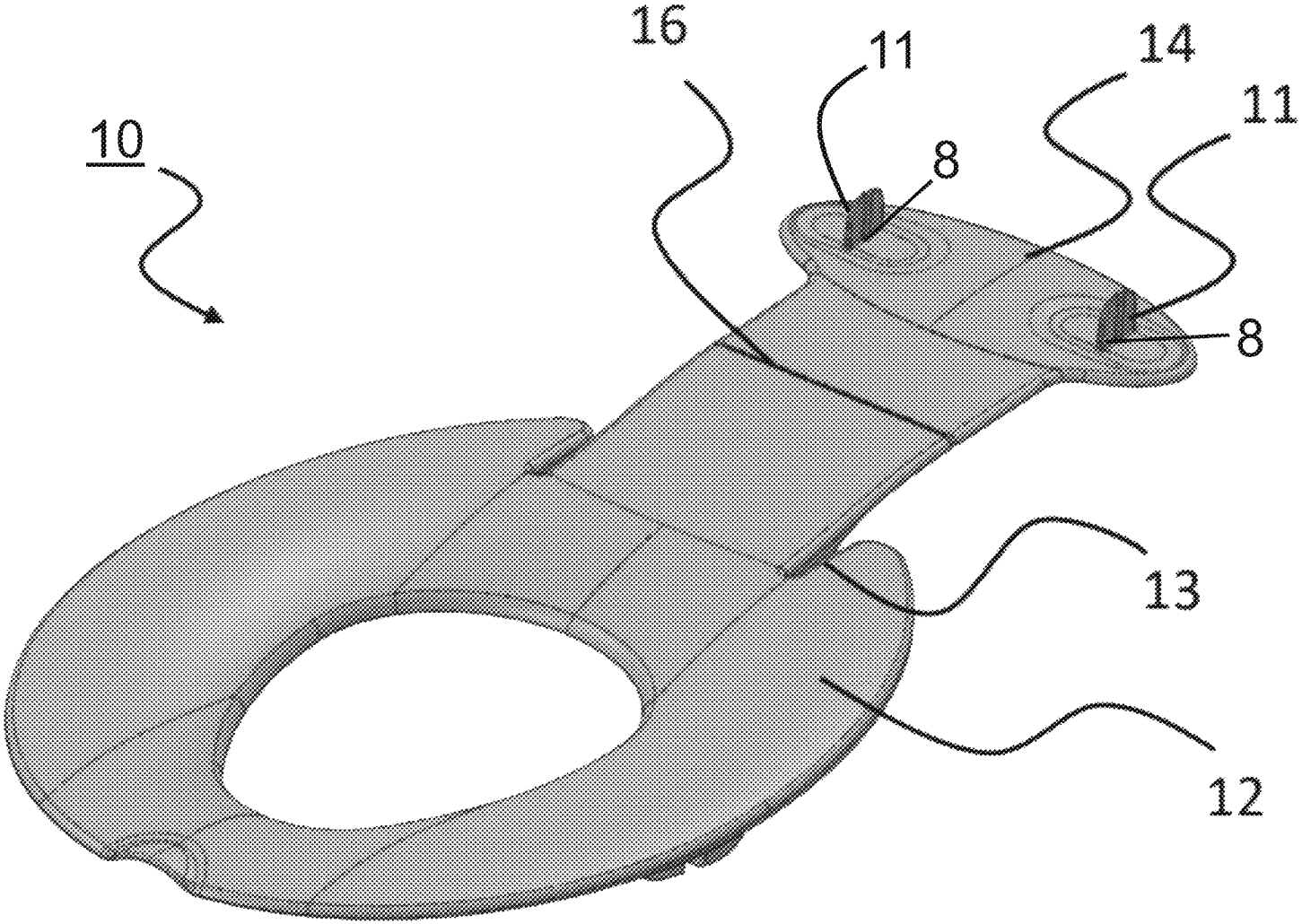
FIG. 5 is a perspective top view of a flip-up potty seat according to an embodiment.

Turning now to FIG. 5, in some embodiments, the flip-up potty seat can be further comprising one or more tabs 11 on the mount capable of engaging with a portion 13 of the ring 12 when the ring is flipped up to contact the one or more tabs on the mount as illustrated in FIG. 4; wherein the one or more tabs are operative to hold the ring in the flipped-up position until the ring is pulled down to the potty-training use position. In various other embodiments, the one or more tabs can be configured as magnets, hook-and-loop fasteners, or any other suitable fastener known in the art.

In another example of FIG. 5, illustrating a perspective view of a flip-up potty seat 10, according to an embodiment of the present disclosure, the tabs 11 can be optionally flexibly attached at 8. As shown, the flip-up potty seat 10 includes the ring 12 that can be connected to the mount 14 via the living hinge 16, where the various components can function and be manufactured similar to those described above. In this embodiment, the mount 14 further includes the pair of tabs 11 which can engage with complementary recesses 13 adjacent the ring 12. The tabs 11 and the recesses 13 can frictionally engage when the ring 12 of the flip-up potty seat 10 is flipped up in a stowed configuration similar to that shown in FIG. 4.

Figure 6:
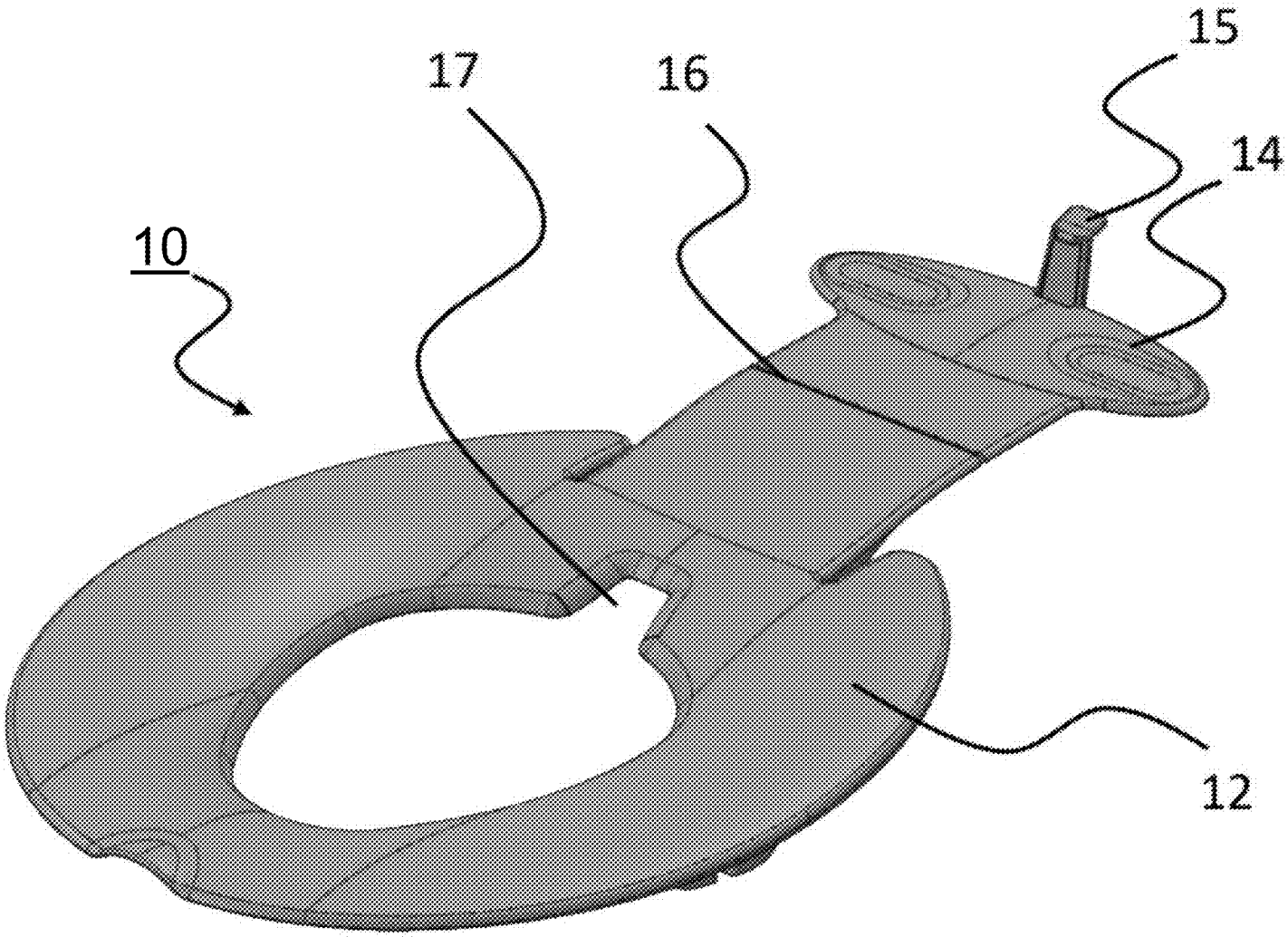
FIG. 6 is a perspective top view of a flip-up potty seat according to an embodiment.

It is contemplated that the tabs 11 can optionally include such things as magnetic force that adheres to the ring 12 when it is flipped-up or other fasteners. In another example, reference is made to FIG. 6 illustrating a perspective view of a flip-up potty seat 10 according to an embodiment of the present disclosure. As shown, the flip-up potty seat 10 includes a ring 12 that can be connected to a mount 14 via a living hinge 16, where the various components can function and be manufactured similar to those shown above and will not be elaborated further herein. In this embodiment, the mount 14 further includes a central pillar 15 which can engage with an aperture 17 about a center of the ring 12. The pillar 15 and the aperture 17 can frictionally engage when the ring 12 of the flip-up potty seat 10 is flipped up in a stowed configuration similar to that shown in FIG. 4.

As mention above, although not shown, it will be appreciated and understood that the flip-up potty seat 10 can be thin enough so as to fit into the gap between the toilet seat 22 and the toilet lid 24 of a regular, adult-sized toilet 20 so that the flip-up potty seat 10 can be safely stored therein when the toilet lid 24 is closed and the toilet 20 is not being used. In some embodiments, the flip-up potty seat 10 can be easily installed on a regular adult-sized toilet seat 22 without the use of any mechanical fasteners or tools. In other words, no mechanical fasteners or tools are needed for the ease of installing the disclosed flip-up potty seat 10 on the regular, adult-sized toilet 20. In some embodiments, the flip-up potty seat is configured wherein the mount can be attached to the underside of the toilet lid of the regular, adult-sized toilet lid by any means known in the art. For example, wherein the mount is attached with an adhesive pad, a hook-and-loop fastener (e.g., Velcro®) with adhesive, one or more suction cups, a magnet with adhesive, a fastener or a clamp.

Figure 7:
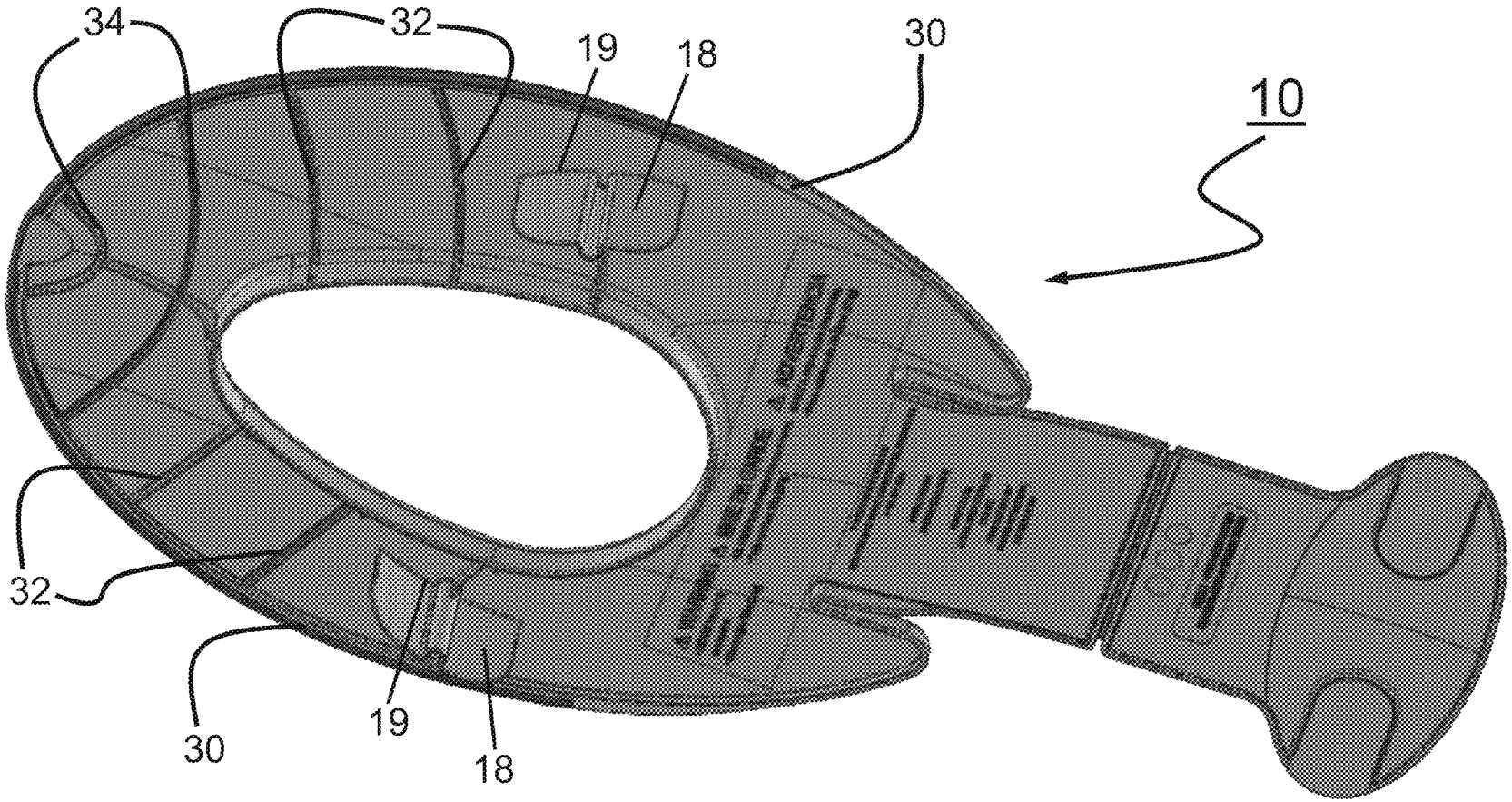
FIG. 7 is a perspective bottom view of a flip-up potty seat illustrated with an added over-molded bead of TPE material 30 to create grip on the toilet seat and non-slip (strength) ribs 32, 34 to add strength and/or additional friction.
Figure 8:
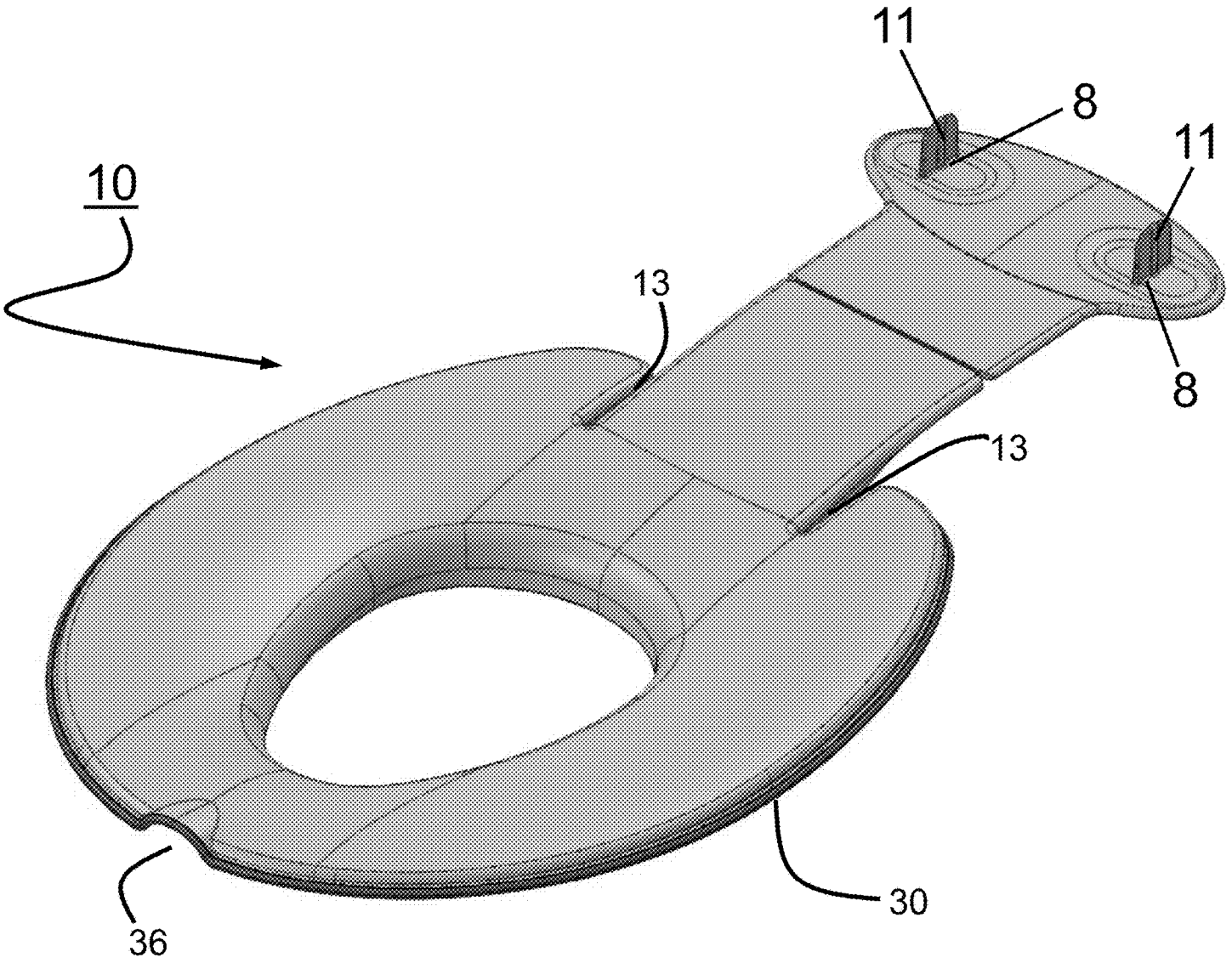
FIG. 8 is a perspective top view of a flip-up potty seat with an adjusted overall size on the molded bead of TPE material 30, and the addition of the TPE gives enough strength/grip that the ribs and tabs (18) (in FIG. 7) can optionally be eliminated as in the image of FIG. 9.
Figure 9:
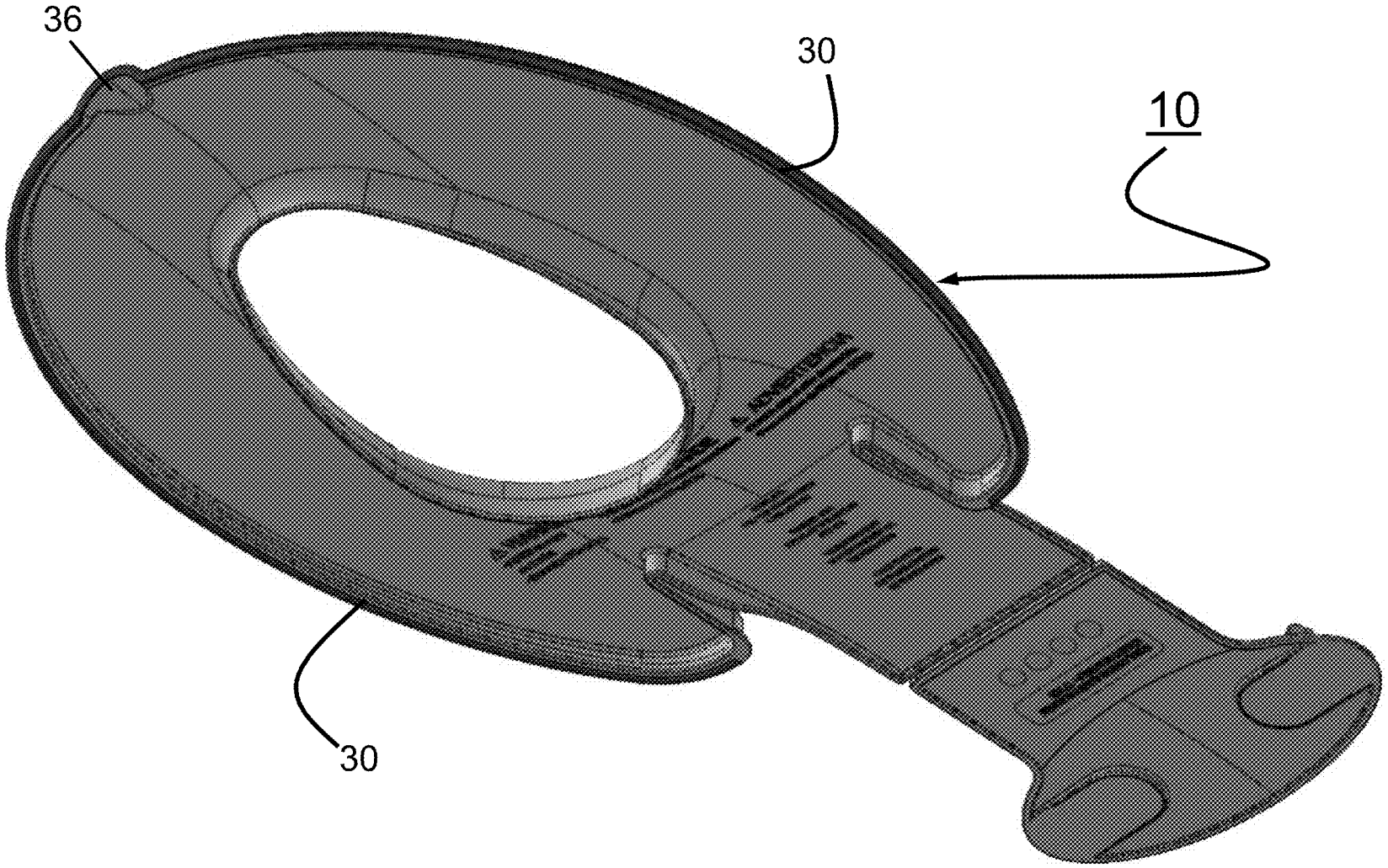
FIG. 9 is a perspective bottom view of a flip-up potty seat with the ribs and tabs (FIG. 7) optionally eliminated.

Turning now to the example shown in FIG. 7, an over-molded bead of TPE material 30 has been added to create grip on the toilet seat and ribs 32, 34 to add additional strength. As illustrated in FIG. 8, in a future embodiment adjusting the overall size and the addition of the TPE will give enough strength/grip that the ribs and tabs can be eliminated as in the example shown in the bottom view of FIG. 9. It should be understood that any of the options shown in FIG. 7 such as non-slip ribs 32, 34 and/or over-molded bead material 30 can be utilized with any of the other options and that these examples are not limited by the illustrative figures. As shown in FIG. 7 and in FIG. 8, the tabs 18 can be flexibly attached at 19 (FIG. 7) and/or the tabs 11 can be flexibly attached at 8 (FIG. 8), wherein flexibly attached can be one or more additional living hinges, as needed. Although FIG. 9 is shown without the various options, it is contemplated that the options can be combined as needed in the spirit of the technology disclosed.

A such, in some embodiments, the flip-up potty seat can be further comprising one or more complementary recesses 13 (FIG. 8) on the ring, opposite the one or more tabs 11; wherein the one or more complementary recesses can frictionally engage with the one or more tabs on the mount. It is contemplated that optionally, the one or more complementary recesses can be, in some embodiments, configured as metal or magnets or complimentary hook-and-loop material if, as discussed above, the one or more tabs are configured with a different fastener known in the art. The catch 36 is optionally used to lift the ring up.

In some embodiments, the flip-up potty seat can be configured wherein the one or more tabs each include a hinge 8 (FIG. 8) operative to dispose each tab in a flush position with the mount and to dispose each tab in an engagement position about perpendicular from the mount. In some embodiments, the flip-up potty seat is configured wherein the hinge is a living hinge. It is contemplated that any hinge or material suitable to provide the concepts disclosed herein can be utilized and the manufacturing (method of making) can be determinative.

In some embodiments, the flip-up potty seat is configured further comprising the two stabilizer tabs 18 (e.g., FIG. 7) projecting downwards from the ring; wherein the two stabilizer tabs are operative to engage with the toilet seat's inner hole of the regular, adult-sized toilet seat and stabilize the ring in the potty-training use position.

In some embodiments, the flip-up potty seat, further comprising the two stabilizer tabs is configured such that the tabs are elongated to form a stabilizing ring or at least a portion of a stabilizing ring (not shown) that is operative to engage with the adult toilet seat's inner hole of the regular, adult-sized toilet seat and stabilize the ring in the potty-training use position.

In some embodiments, the flip-up potty seat is such that the two stabilizer pads are hinged 19 (FIG. 7) and operative to be moved flush with the ring when the ring is flipped-up to the adult-use position or storage position.

Figure 12A:
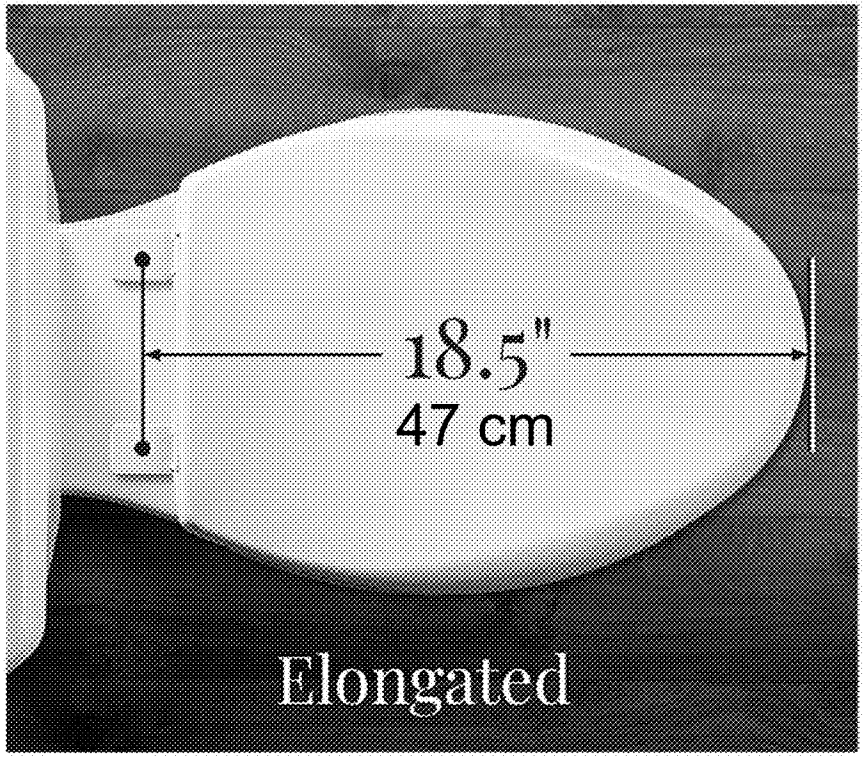
FIG. 12A and FIG. 12B show photographs and dimensional examples of elongated and round adult size toilet seats' dimensions[1].
Figure 12B:
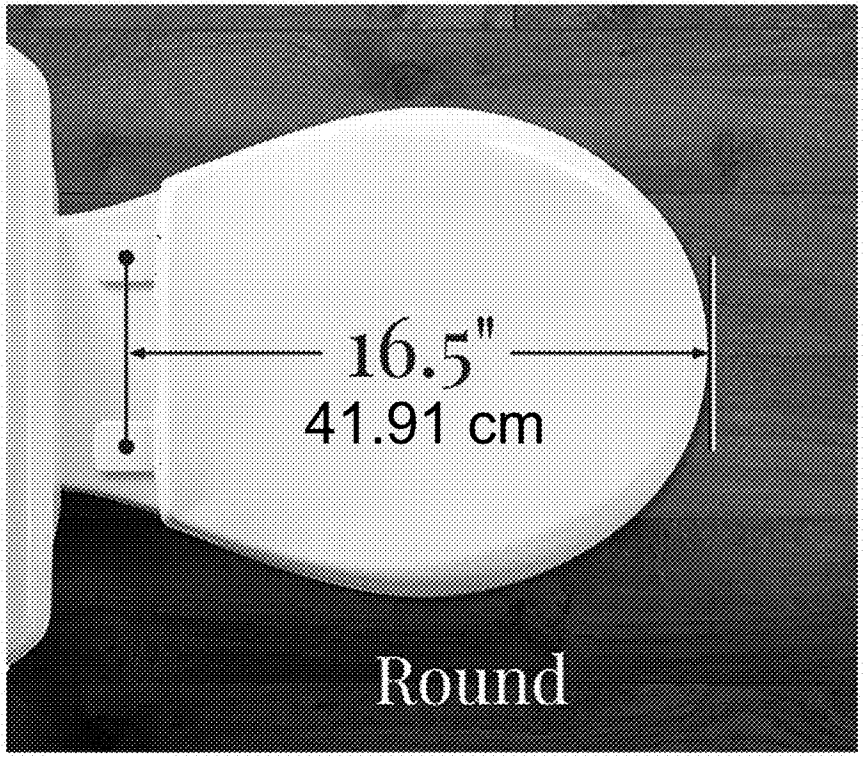

The flip-up potty seat can be utilized with elongated, adult-sized toilet seats (e.g., FIG. 12A) or with round (FIG. 12B). The flip-up potty seat is wherein the ring of the flip-up potty seat reduces the dimension of the toilet seat's inner hole of the regular, adult-sized toilet seat. The flip-up potty seat is configured wherein the reduced dimension of the inner hole is operative to prevent a toddler or child from falling through the inner hole of the regular, adult-sized toilet seat.

Figure 13A:
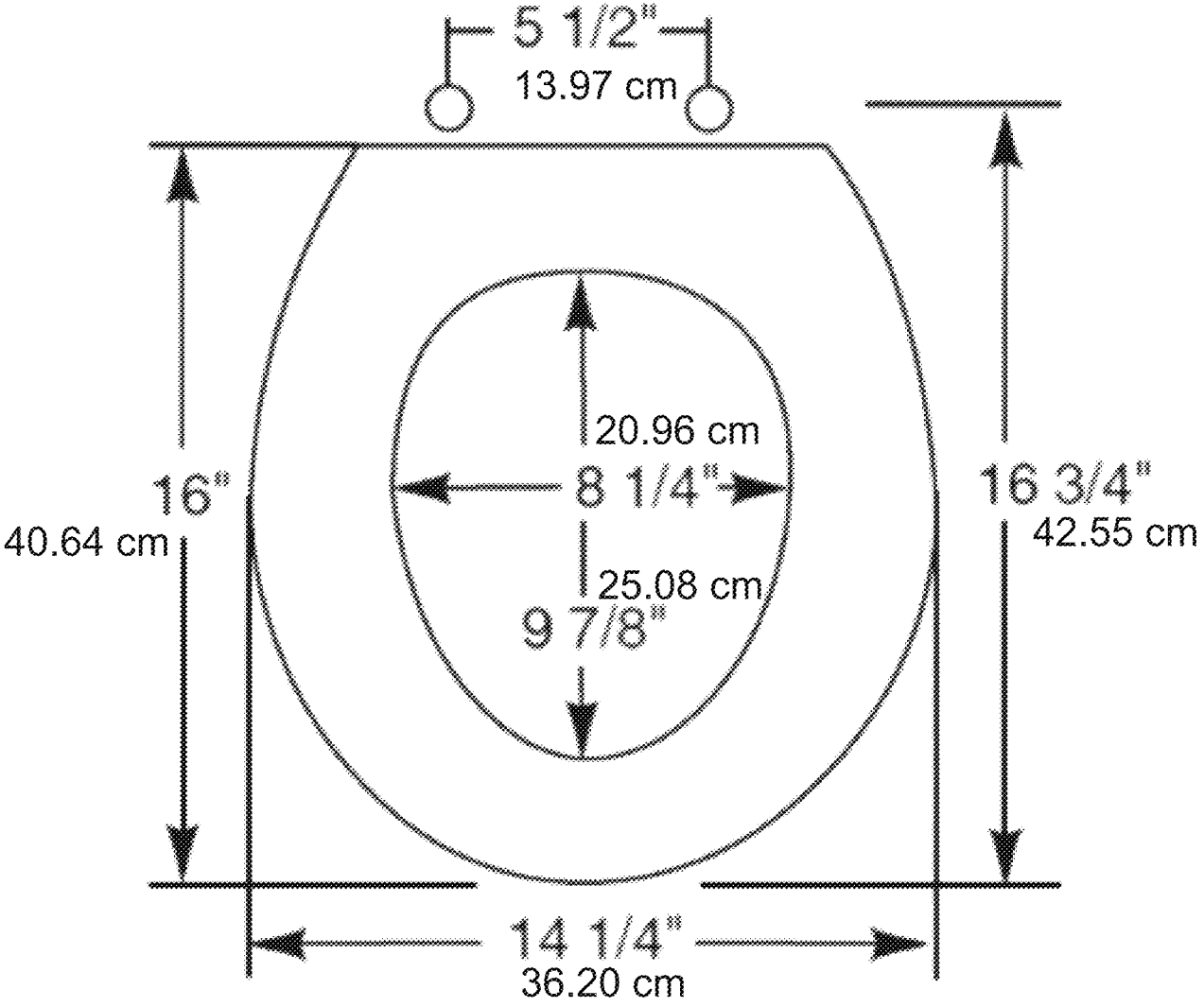
FIG. 13A, FIG. 13B and FIG. 13C show example dimensions of adult size toilet seats' dimension.
Figure 13B:
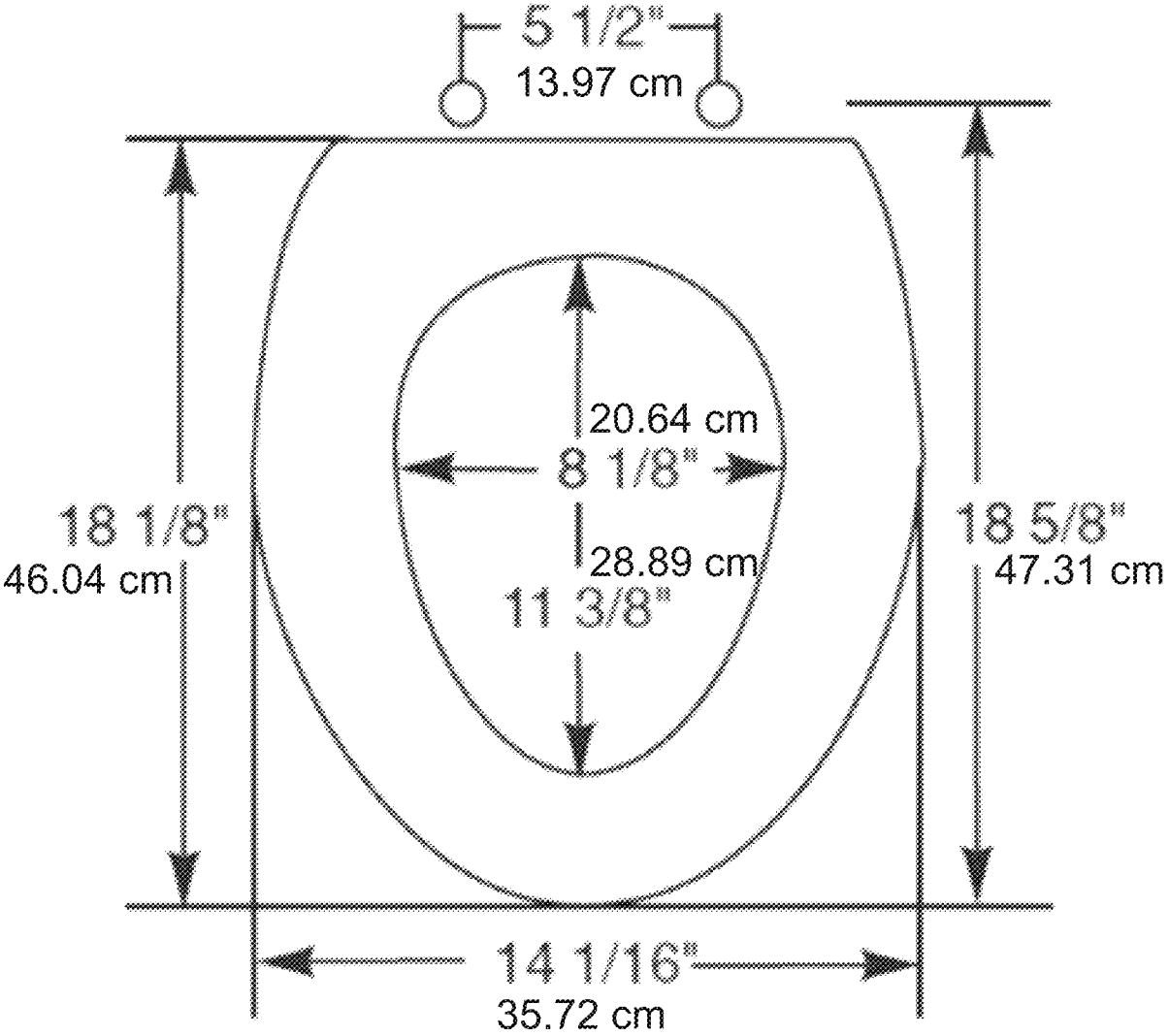

In non-limiting examples of various dimensions, turning to FIG. 13A and FIG. 13B, the flip-up potty seat can be produced to be about 0.5 inch (1.27 cm) less at the inner hole diameter than the 8⅛" (20.64 cm) to 8¼" (20.96 cm) (FIG. 13A, FIG. 13B) and about 0.5 inch (1.27 cm) less at the inner hole diameter than the 9⅞" (24.77 cm) to 11⅜" (28.89 cm); optionally about 1 inch (2.54 cm) less, optionally about 1.5 inch (3.81 cm) less, optionally about 2 inches (5.08 cm) less, or optionally about 0.5" (1.27 cm) to about 4 inches (10.16 cm) less for each dimension (or any point subsumed in the ranges). In another example in FIG. 13C, the $X_{HOLE}$ and $Y_{HOLE}$ dimensions are made smaller in the flip-up potty seat by about 0.5" (1.27 cm) to about 4 inches (10.16 cm). In some embodiments, the 'B' or bolt dimensions can optionally vary without changing requirements of the flip-up potty seat. In some embodiments, the $Y_B$ dimension (total length to bolts) can vary. In some embodiments, the flip-up potty seat can optionally be made slightly larger than the X and Y dimensions. It is contemplated that in some embodiments, the flip-up potty seat can be smaller than the X and Y dimensions. Examining FIGS. 14A-14R and FIG. 15, it can be seen that the flip-up potty seat can be made to accommodate a variety of shapes and even to span an Open Fronted shape (FIG. 15) if needed. In this example, such a span can comfort a toddler confronted with an Open Fronted shape in a bathroom.

Figure 13C:
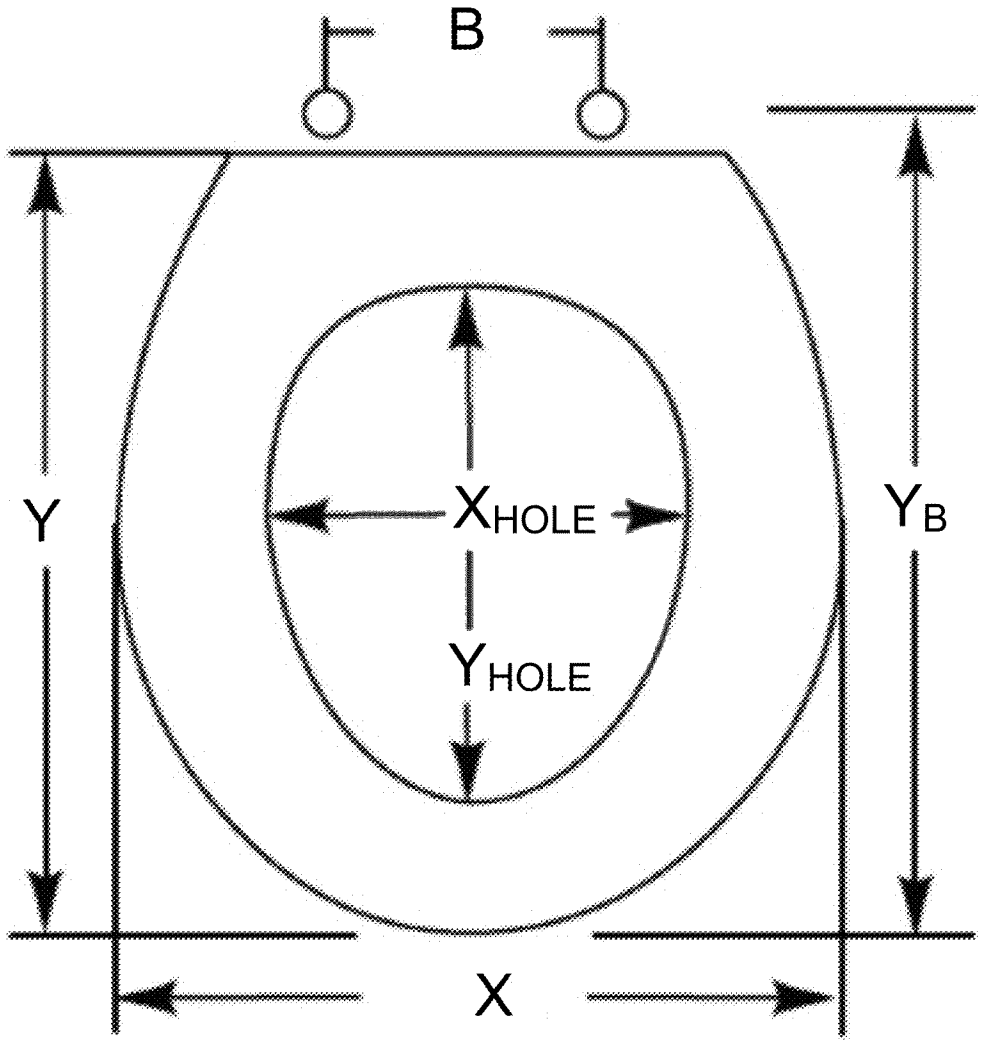
Figure 14A:
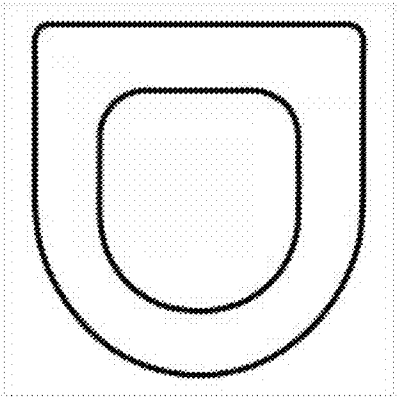
FIGS. 14A-14R show examples of various (adult-size) toilet seat shapes.
Figure 14B:
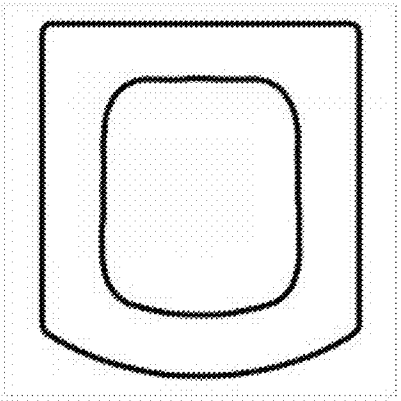
FIG. 14B shows an example of a Smiley D shape toilet seat.
Figure 14C:
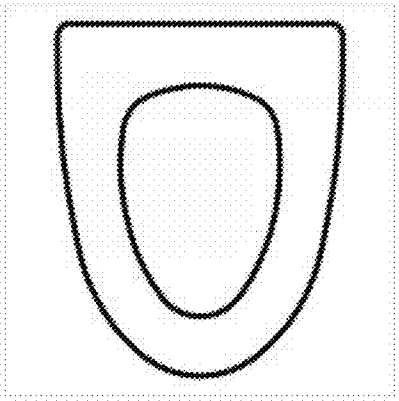
FIG. 14C shows an example of a Pointed shape toilet seat.
Figure 14D:
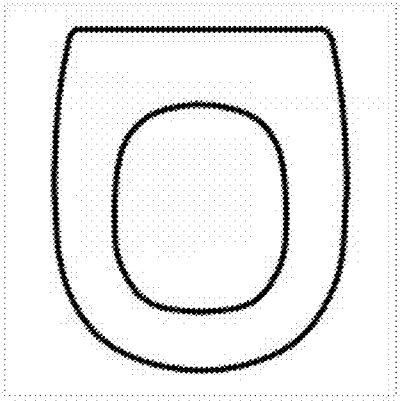
FIG. 14D shows an example of a Curved D shape toilet seat.
Figure 14E:
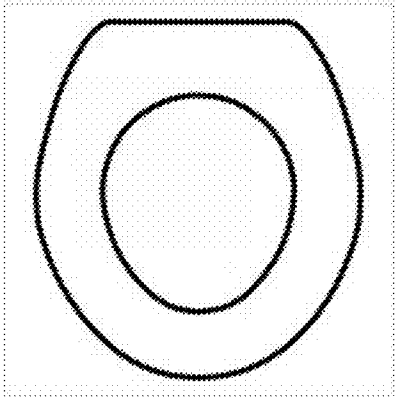
FIG. 14E shows and example of Standard Universal shape toilet seat.
Figure 14F:
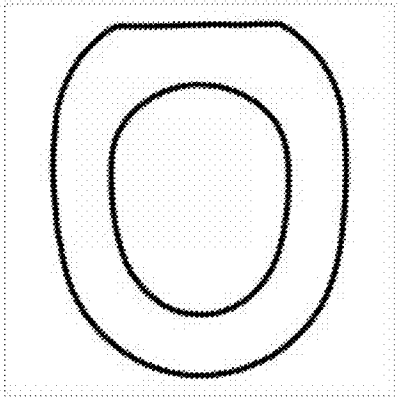
FIG. 14F shows an example of an Oval shape toilet seat.
Figure 14G:
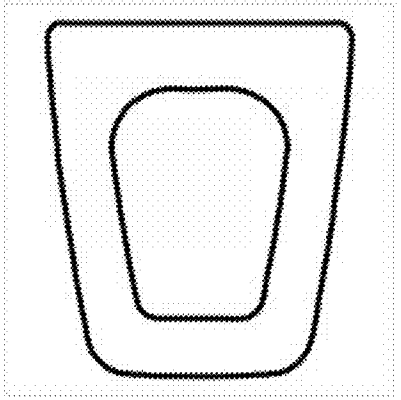
FIG. 14G shows an example of a Special Flat Front shape toilet seat.
Figure 14H:
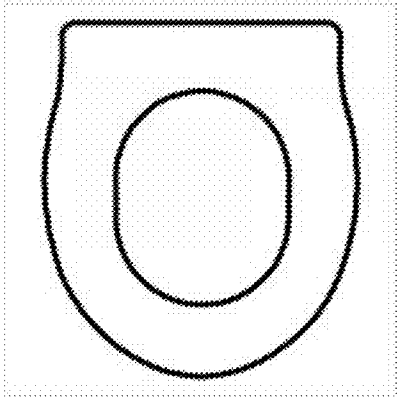
FIG. 14H shows an example of a Special Round Front shape toilet seat.
Figure 14I:
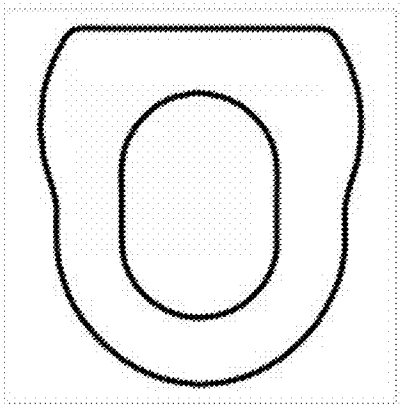
FIG. 14I shows an example of a Wavy Side shape toilet seat.
Figure 14J:
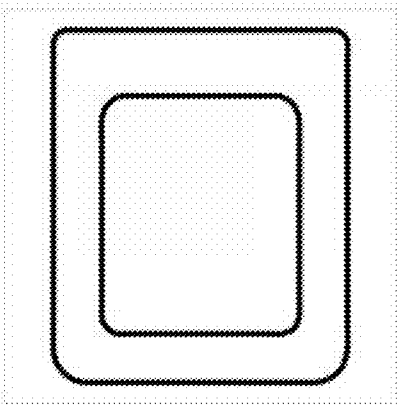
FIG. 14J shows an example of a Square Shape toilet seat.
Figure 14K:
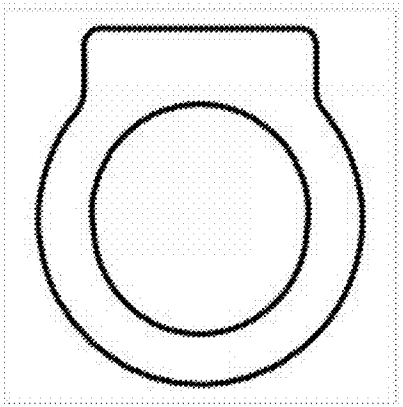
FIG. 14K shows an example of a Round shape toilet seat.
Figure 14L:
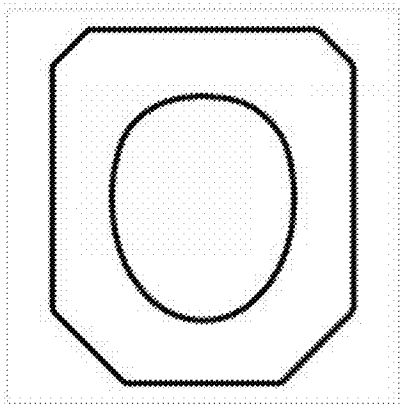
FIG. 14L shows an example of an Octagonal shape toilet seat.
Figure 14M:
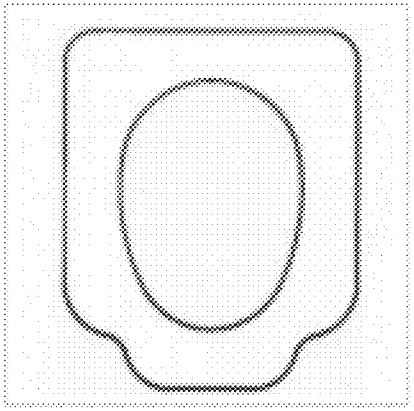
FIG. 14M shows an example of a Globo Canova shape toilet seat.
Figure 14N:
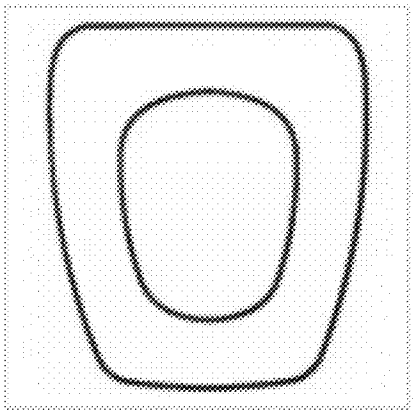
FIG. 14N shows an example of a Special (custom) shape toilet seat.
Figure 14O:
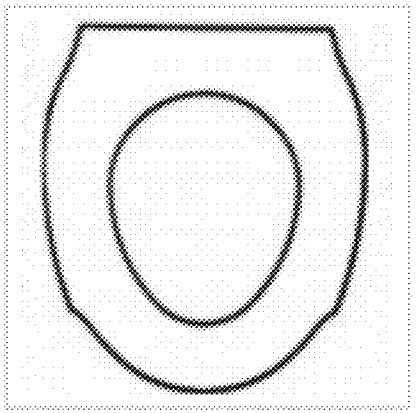
FIG. 14O shows an example of an Oceano Original shape toilet seat.
Figure 14P:
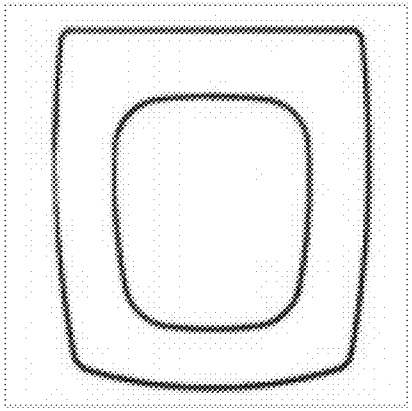
FIG. 14P shows an example of a Special Square (custom) toilet seat.
Figure 14Q:
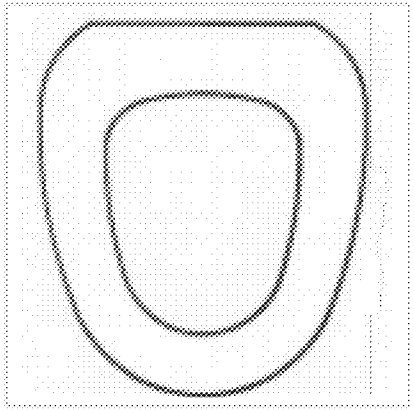
FIG. 14Q shows an example of a Standard (customized) Oval shape toilet seat.
Figure 14R:
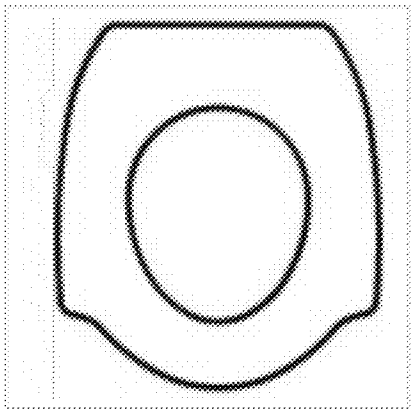
Figure 15:
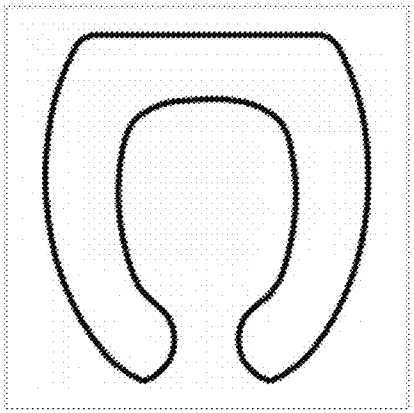
FIG. 15 shows an example of an Open Fronted shape (adult-size) toilet seat that can be combined (i.e., the open front can be configured) with the shape of any one of FIGS. 14A-14R.

Upon seeing the variable dimensions in FIG. 13C, it is demonstrated that the technology can accommodate various shapes and sizes of adult-sized toiled seats as illustrated in FIGS. 14A-14R and FIG. 15. In some embodiments, the flip-up potty seat is wherein the flip-up toilet seat ring can be positioned down on the toilet seat of the regular, adult-sized toilet seat, in the potty-training use position and then flipped-up to the adult use position or a stowed position in less than 5 seconds (e.g., FIG. 11); and/or wherein the flip-up toilet seat ring can be flipped-down from the adult use position or stowed position into the potty-training use position in less than 5 seconds. In some embodiments, the flip-up toilet seat ring can be positioned down on the toilet seat of the regular, adult-sized toilet seat, in the potty-training use position and then flipped-up to the adult use position or a stowed position in less than 1 second; and/or wherein the flip-up toilet seat ring can be flipped-down from the adult use position or stowed position into the potty-training use position in less than 1 second.

In some embodiments, the flip-up potty seat is configured further comprising a molded bead (e.g., FIG. 7, FIG. 8, FIG. 9) extending down from an outer circumference of the underside of the flip-up toilet seat ring and operative to provide a grip on or around the outer circumference of the regular, adult-sized toilet seat. In some embodiments, the flip-up potty seat is configured, further comprising one or more underside non-slip ribs including a molded bead extending from the inner hole of the flip-up potty seat to the outer circumference of the flip-up potty seat or along a span of the underside of the flip-up potty seat and each rib operative to provide rigidity and/or strength to the flip-up potty seat.

In some embodiments, the flip-up potty seat disclosed herein enables a substantially instant or an almost instantaneous conversion of a regular, adult-sized toilet seat to a potty-training use position and vice versa. The flip-up potty seat disclosed herein can improve sanitation compared to a potty chair.

In some embodiments, the flip-up potty seat consists of the mount, the flip-up ring and the hinge. In some embodiments, the flip-up potty seat consists essentially of a single material meaning as such that the entire flip-up potty seat, living hinge and mount is made by being injection-molded from a single material. In various examples, the flip-up potty seat is formed from a recyclable material (e.g., an injection-molded plastic or polymer).

In some embodiments, a method of potty training a toddler is disclosed herein, the method comprising the steps of: (1) obtaining a flip-up potty seat of any preceding description with mount engaged with the lid and the ring positioned down on the toilet seat of the regular, adult-sized toilet seat in the potty-training use position; (2) positioning a toddler over the ring in a potty seated position on the ring; and (3) encouraging the toddler; whereby the toddler remains seated for a sufficient period of time.

In some embodiments, a method of converting a regular, adult sized toilet seat to a potty-training toilet seat (and/or vice versa) is disclosed herein, the method comprising the steps of: (1) obtaining a flip-up potty seat of any of the embodiments herein with mount engaged with the lid and the ring positioned up from the toilet seat to contact the mount and to stay in contact with the mount; wherein the ring is thereby in a regular, adult use position or a stowed position; and (2) flipping the ring down from contact with the mount to contact the regular, adult sized toilet seat and to be in the potty-training use position; wherein an execution of step (1) and/or step (2) is utilized as needed to interconvert from the potty-training use position to (or from) the regular, adult use position (or the stowed position). For example, in some embodiments, this method can be executed in less than about 5 seconds, in less than about 1 second, or about instantly.

In some embodiments, a method of converting a regular, adult-sized toilet to a potty-training or special use toilet or vice versa, the method comprising the steps of: (A) obtaining a flip-up potty seat of any one of the embodiments described herein and engaging the mount with the lid of an adult-sized toiled seat; (B) flipping the ring down onto a toilet seat of the regular, adult-sized toilet, whereby the ring transitions to the potty-training position; and (C) flipping the ring up to contact the mount and to stay in contact with the mount; wherein the ring transitions to the regular, adult use position or stowed position. For example, this method can, in some embodiments, enables an interconversion of the regular, adult-sized toilet in less than 5 seconds after the mount is attached to the lid.

In some embodiments, the methods disclosed herein can be wherein the method is executed by a toddler and/or a child after the toddler and/or child is shown the method at least once. The methods disclosed herein are more sanitary than a potty chair, which requires emptying of a receptacle. For example, any of the methods disclosed herein can further comprise flushing said toilet or encouraging a toddler or a child to flush said toilet.

It should be understood that any of the embodiments disclosed herein can be packaged in a kit (e.g., for sale units) with instructions or illustrations of any of the methods disclosed herein. Interestingly, such a kit enables environmentally sound conversion of globally distributed adult-sized toilets for potty training, eliminating the need for devices such as the example shown in FIG. 16.

The methods and flip-up potty seats disclosed herein can accommodate a variety of toilets spanning the globe. The modern toilet comes in many shapes and designs. The publication: "A Collection of Contemporary Toilet Designs—EOOS and WEDC" (Shaw, R. Editor, 2014)[4] shows various toilet designs after the Bill & Melinda Gates Foundation initiated the "Reinvent the Toilet Challenge" to further global and sustainable sanitation solutions. For example, the publication shows the "Cinderella" toilet, "Camping" toilet, the "Waterless" toilet and a public restroom toilet. The technology disclosed herein can be adapted to a wide variety of toilets, private or public.

While example embodiments have been particularly shown and described, it will be understood by those skilled in the art that various changes in form and details may be made therein without departing from the scope of the embodiments encompassed by the appended claims. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure

EXAMPLES

Example 1: Production of Injection Molded Prototypes

Prototypes of the potty chairs shown in FIG. 1 and FIG. 2 are injection molded from a single polymer (consisting of a single polymer). The manufacturing process is prophetically tried using different polymers, and it is found that recyclable polymers can be utilized for the injection molding to form the living hinge, mount and ring all at once.

The convenience of using a single material is found to be cost saving and environmentally sound/sustainable. The method of making by an injection mold is thus described (and claimed) as "consisting essentially of" to emphasize the benefits obtained in combination with the method of making the example articles.

Example 2: Testing Methods of Converting Toilet Seat from Adult Use to Potty Training Use In this prophetic and comparative example, the configuration illustrated in FIG. 4 is "flipped down" to the configuration illustrated in FIG. 3. Next, the configuration illustrated in FIG. 3 is "flipped-up" to the configuration in FIG. 4. It is found that the conversion (back and forth or vice versa) can be done in less than about 5 seconds. In this example, it is contemplated that the flowchart shown in FIG. 11 can be executed (B) to (C) and vice versa in less than 5 seconds. It is contemplated that a toddler can perform the conversion of step (B) (FIG. 11) after being shown how.

Figure 10:
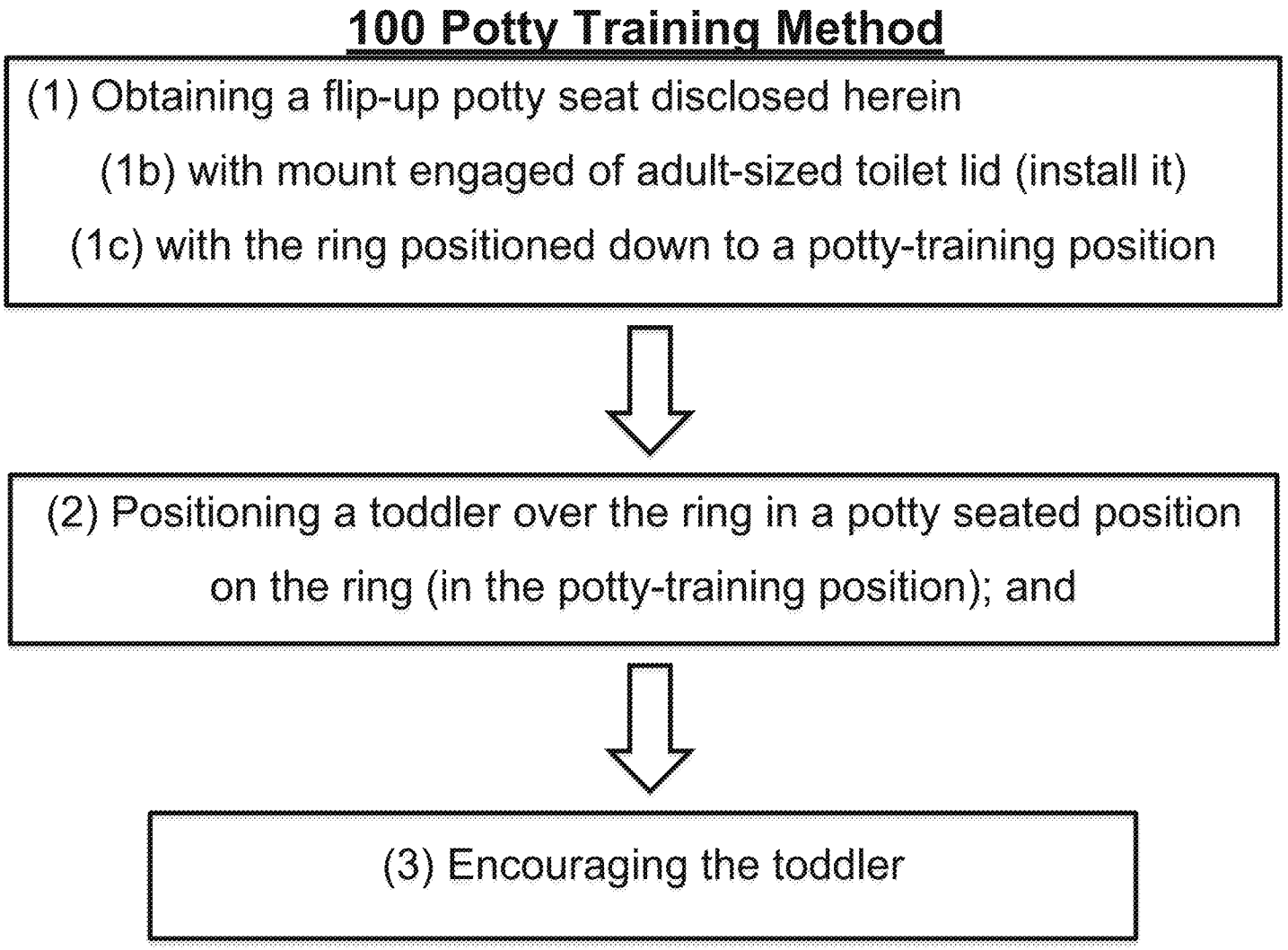
FIG. 10 shows a flow diagram (method 100 of Potty Training) illustrating some features of a method of potty training a toddler using any of the flip-up potty seats illustrated in FIGS. 1-9.
Figure 11:
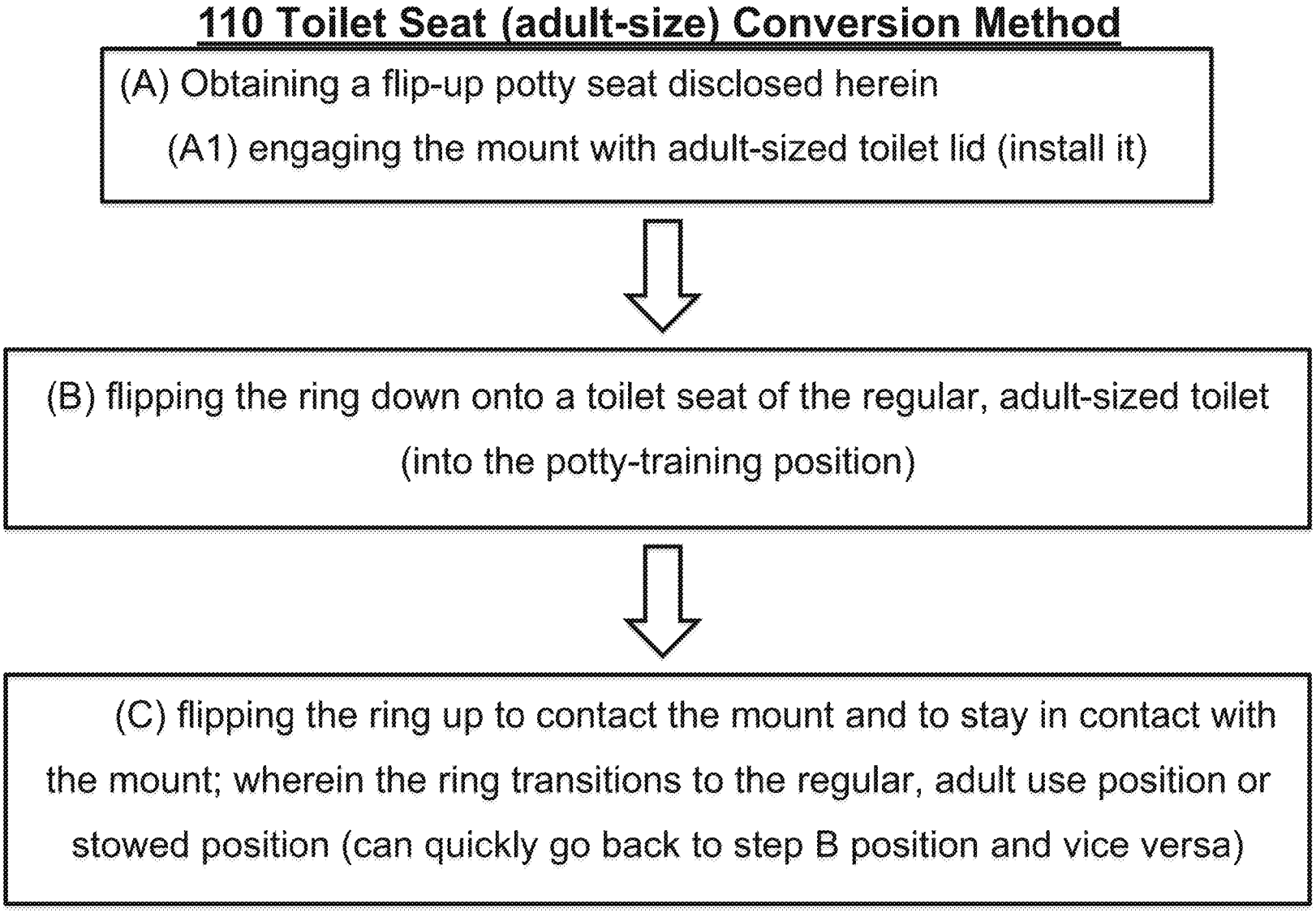
FIG. 11 shows a flow diagram illustrating some features of a nearly instant method (110 Toilet Seat, adult-size, Conversion Method) of converting a standard, adult sized toilet to and from a child potty (and then vice versa) using any of the flip-up potty seats illustrated in FIGS. 1-9.

After the speed comparisons, the flip-up potty seat is packaged in a kit (for sale package) including the flip-up potty seat and instructions or illustrations of one or more steps of FIG. 10 (100 Potty Training Method) or FIG. 11 (110 Toilet Seat (adult-size) Conversion Method).

REFERENCES

1. Two sizes are illustrated, © by Bemis® Manufacturing Co. and are in common fair use; see: toiletseats.com/assets/Uploads/ProductFiles/File/TScom-size-guide.pdf
2. Example shapes adapted from various Google searches and from viewing: choicereplacementtoiletseatshop-.co.uk/c/shop-by-shape (no copyright at all is indicated as of 26 Nov. 2023).
3. see: merriam-webster.com/dictionary/potty-chair or "Potty-chair." Merriam-Webster.com Dictionary, Merriam-Webster, merriam-webster.com/dictionary/potty-chair. Accessed 26 Nov. 2023.
4. A Collection of Contemporary Toilet Designs, ISBN: 9781843801559, by Rod Shaw (Editor), published by WEDC (Jan. 15, 2014)

What is claimed is:

1. A flip-up potty seat configured for potty training of toddlers on a regular, adult-sized toilet seat, the flip-up potty seat comprising:

a mount operative to be attached to an underside of a toilet lid of a regular, adult-sized toilet seat, the mount comprising an attachment selected from the group consisting of an adhesive pad, a hook-and-loop fastener with adhesive, one or more suction cups, a magnet with adhesive, a fastener, and a clamp, each configured to removably affix the mount to the underside of the toilet lid;

a flip-up toilet seat ring connected to the mount via a living hinge, wherein the ring can be positioned down on the toilet seat of the regular, adult-sized toilet seat; wherein the ring is thereby in a potty-training use position;

wherein the ring comprises two stabilizer tabs projecting downward from the ring and operative to engage an inner hole of the regular, adult-sized toilet seat and stabilize the ring in the potty-training use position; wherein the mount includes one or more hinged tabs each movable from a flush position with the mount to an engagement position about perpendicular from the mount, and the ring includes one or more complementary recesses oppositely disposed to frictionally engage with the one or more hinged tabs when the ring is flipped up to contact the mount so as to hold the ring in a flipped-up position until the ring is pulled down to the potty-training use position; wherein the flip-up potty seat is thin enough to fit into a space between the toilet seat and the lid of the regular, adult-sized toilet seat so that the flip-up potty seat can be safely stored between the toilet seat and the lid when the lid is closed;

wherein the ring can be flipped up from the toilet seat to contact the mount and to stay in contact with the mount; wherein the ring is thereby in a regular, flipped-up adult use position or a stowed position; and wherein, in the stowed position, the ring is held against the mount by said frictional engagement between the one or more complementary recesses and the one or more hinged tabs.

2. The flip-up potty seat of claim 1, wherein the mount is attached to an underside of the toilet lid of the regular, adult-sized toilet by two or more suction cups.

3. The flip-up potty seat of claim 1, wherein the two stabilizer tabs are hinged and operative to be moved flush with the ring when the ring is flipped-up to the adult-use position or stowed position.

4. The flip-up potty seat of claim 1, wherein the flip-up toilet seat ring can be positioned down on the toilet seat of the regular, adult-sized toilet seat, in the potty-training use position and then flipped-up to the adult use position or a stowed position in less than 5 seconds; or wherein the flip-up toilet seat ring can be flipped-down from the adult use position or stowed position into the potty-training use position in less than 5 seconds.

5. The flip-up potty seat of claim 1, further comprising a molded bead extending down from an outer circumference of an underside of the flip-up toilet seat ring and operative to provide a grip on or around the outer circumference of the regular, adult-sized toilet seat.

6. The flip-up potty seat of claim 1, further comprising one or more underside non-slip ribs including a molded bead extending from an inner hole of the flip-up potty seat to an outer circumference of the flip-up potty seat or along a span of an underside of the flip-up potty seat and each rib operative to provide rigidity or strength to the flip-up potty seat.

7. The flip-up potty seat of claim 1 that consists essentially of a single material as such that the entire flip-up toilet seat's ring, living hinge and mount are made by being injection-molded from a single material.

8. The flip-up potty seat of claim 7 that is a recyclable, environmentally sound material.

9. A method of potty training a toddler, the method comprising the steps of:

(1) obtaining the flip-up potty seat of claim 1;

(2) positioning a toddler over the ring in a potty seated position on the ring; and (3) encouraging said toddler; whereby the toddler remains seated for a sufficient period of time.

10. The method of claim 9, wherein execution of the method is more sanitary or cleaner than a potty chair.

11. The method of claim 9, further comprising flushing said toilet or encouraging a toddler or a child to flush said toilet.

12. A method of converting a regular, adult sized toilet seat to a potty-training toilet seat or back, the method comprising the steps of:

(1) obtaining the flip-up potty seat of claim 1 and attaching it to an adult sized toilet seat;

(2) flipping the ring down from contact with the mount to contact the regular, adult sized toilet seat and to be in the potty-training use position;

wherein an execution of step (1) or step (2) interconverts between the potty-training use position and a regular, adult-use position or the stowed position.

13. The method of claim 12 that can be executed in less than 5 seconds, in less than 1 second, or about instantly.

14. The method of claim 12, further comprising the method is executed with steps of a method of converting a regular, adult-sized toilet to a potty training use position or back, the method further comprising the steps of:

(0) obtaining the flip-up potty seat of claim 1, ensuring it is attached, and engaging the mount with the lid of an adult-sized toilet seat, and thereby not executing step (1) of claim 12;

(2) flipping the ring down onto a toilet seat of the regular, adult-sized toilet, whereby the ring transitions to the potty-training use position; and (3) flipping the ring up to contact the mount and to stay in contact with the mount; wherein the ring transitions to the regular, adult use position or stowed position.

15. The method of claim 12, wherein the method is executed by a toddler or a child after the toddler or child is shown a demonstration of the method at least once.

* * * * *